US012460487B2

(12) United States Patent
Gerhardt et al.

(10) Patent No.: US 12,460,487 B2
(45) Date of Patent: Nov. 4, 2025

(54) DRILL HEAD FOR CREATING A BOREHOLE IN THE GROUND

(71) Applicant: Herrenknecht AG, Schwanau (DE)

(72) Inventors: Tobias Gerhardt, Teningen (DE); Boris Jung, Schutterwald (DE)

(73) Assignee: Herrenknecht, Schwanau (DE)

( * ) Notice: Subject to any disclaimer, the term of this patent is extended or adjusted under 35 U.S.C. 154(b) by 554 days.

(21) Appl. No.: 17/628,856

(22) PCT Filed: Jul. 21, 2020

(86) PCT No.: PCT/EP2020/070563
§ 371 (c)(1),
(2) Date: Sep. 5, 2022

(87) PCT Pub. No.: WO2021/013838
PCT Pub. Date: Jan. 28, 2021

(65) Prior Publication Data

US 2024/0209699 A1 Jun. 27, 2024

(30) Foreign Application Priority Data

Jul. 24, 2019 (DE) ..... 10 2019 120 019.9

(51) Int. Cl.
*E21B 21/00* (2006.01)
*E21D 1/06* (2006.01)

(52) U.S. Cl.
CPC ..... *E21B 21/00* (2013.01); *E21D 1/06* (2013.01)

(58) Field of Classification Search
CPC ..... E21B 21/00; E21B 21/16; E21B 10/18; E21B 10/60; E21B 10/62; E21D 1/06; E21D 9/11
See application file for complete search history.

(56) References Cited

U.S. PATENT DOCUMENTS 3,360,061 A 12/1967 Canalizo
3,384,191 A 5/1968 Schumacher et al.
3,648,788 A * 3/1972 McKinney ..... E21B 27/00 175/69

(Continued)

FOREIGN PATENT DOCUMENTS

DE 2829834 A1 1/1979
DE 1962591 C1 4/1984

(Continued)

*Primary Examiner* — Robert E Fuller
(74) *Attorney, Agent, or Firm* — Mark Rodgers

(57) ABSTRACT

A drill head for creating a substantially vertical borehole in the ground, includes a body connected to a rotational drive of a drilling device; drilling tools on the body, for loosening the ground at a working face of the borehole; suctioning elements for leading away the loosened ground, which can be connected to a pump, and the suctioning elements include an opening region on the body and with at least one opening in the region of the drilling tools. The opening region has may have an elongate extent, and is connected to a suction box with an opening for connecting to the pump. The loosened ground can be sucked through the opening into the suction box with the pump. The suction box is tapered in width from the opening toward the connection opening, and that the height of the suction box increases from the opening toward the connection opening.

11 Claims, 33 Drawing Sheets

(56) References Cited

U.S. PATENT DOCUMENTS

| | | | | |
|---|---|---|---|---|
| 4,195,700 | A | 4/1980 | Worder | |
| 2013/0008723 | A1 | 1/2013 | Hoelting et al. | |
| 2013/0269220 | A1 | 10/2013 | Matthias et al. | |
| 2018/0230748 | A1 | 8/2018 | Finkenzeller | |
| 2020/0102790 | A1* | 4/2020 | Bauer | E21B 6/04 |

FOREIGN PATENT DOCUMENTS

| | | | | | |
|---|---|---|---|---|---|
| DE | 69013666 | T2 | | 3/1995 | |
| GB | 2003211 | A | * | 3/1979 | E21B 10/345 |
| KR | 101762879 | B1 | | 7/2017 | |
| WO | 2016142910 | A1 | | 9/2016 | |
| WO | 2018114230 | A1 | | 6/2018 | |
| WO | WO-2021013838 | A2 | * | 1/2021 | E21D 1/06 |

* cited by examiner

DRILL HEAD FOR CREATING A BOREHOLE IN THE GROUND

BACKGROUND

The invention relates to a drill head for creating a substantially vertical borehole in the ground, having a body which is able to be connected to a rotary drive of a drilling device, having drilling tools which for loosening the ground at a face of the borehole are disposed on the body, having a suction system which for discharging the loosened ground at the face is able to be connected to a pump, wherein the suction system has an opening region which is disposed on the body and has at least one opening in the region of the drilling tools at the face.

Such a drill head is known from, for example, DE 19626591 C1, EP 2597249 B1, U.S. Pat. Nos. 3,384,191 A, 4,195,700 A, 4,200,160 A, and WO 2016142910 A1.

DE 19626591 C1 here shows a drill head for establishing vertical boreholes in the soil while excavating the loosened soil according to the pneumatic lifting method. The drill head on the lower side thereof here has drilling tools and a suction system for discharging the loosened soil. The suction system here has an intake opening configured as a radially running duct. The duct per se is connected to a suction tube. The loosened ground conjointly with purging liquid is suctioned from the face by way of the suction tube. Directed nozzles which are directed into the duct and by way of which compressed air or liquid is dispensed for supporting the suction system are provided for support.

EP 2597249 B1 shows a drilling device for establishing vertical boreholes in the soil, having a drill head which rotates on a face. A suction system is provided that has an opening which is disposed externally on the end of the drill head that faces the face and rotates conjointly with the drill head. Loosened ground is discharged from the borehole here.

U.S. Pat. No. 3,384,191 A shows a drill head which has roller chisels and likewise has a suction system for discharging the loosened ground. Provided to this end is a guide plate which is disposed in the region of the opening of the suction system and collects the loosened ground during the rotation of the drill head and feeds said loosened ground to the opening. An oblique duct which opens into a centrically disposed discharge line is disposed behind the opening.

U.S. Pat. No. 4,195,700 A likewise discloses a drill head which has roller chisels and has a radial opening, a discharge line being provided at the inner end of said drill head. The opening is embodied as a slot behind which a conically shaped tube that widens toward the discharge line is provided.

U.S. Pat. No. 4,200,160 A discloses a drill head which has a suction system for discharging the loosened ground. The suction system provides a slot-shaped radial opening which opens into a cylindrical space. A duct which leads into the wastewater line emanates from said cylindrical space.

WO 2016142910 A1 likewise discloses a drill head which has roller chisels and a radial opening with a rim that in the direction of the face projects beyond the lower side of the drill head. A conically shaped space which extends across the entire lower side of the drill head is provided behind the opening. A discharge line is provided at the rear end of said conically shaped space.

SUMMARY

It is an object of the invention to simplify the suction system in the abovementioned drill heads and to simultaneously improve said suction system in terms of its performance.

The object according to the invention according to a first solution according to the invention is achieved in that the opening region has an elongate extent; in that the at least one opening of the opening region is connected to a suction box which at an end opposite the opening has a connector opening for connecting to the pump; in that the ground loosened by the drilling tools in a flow direction is able to be suctioned in the opening region through the opening and into the suction box by the pump; in that the width of the suction box tapers from the opening toward the connector opening; and/or in that the height of the suction box increases from the opening toward the connector opening.

The width of the suction box here is preferably the longitudinal extent of the opening, particularly preferably when viewed radially. The height of the suction box here is preferably the transverse extent of the opening, particularly preferably when viewed transversely to the radial.

As a result thereof, it is possible for the suction rate to be significantly increased in a surprisingly simple manner. At the same time, the risk of blockages in the suction region is significantly reduced in a simple manner.

A further teaching of the invention provides that at least one deflection region, in which the flow direction of the loosened ground is able to be deflected, is provided behind the opening, preferably prior to entering the suction box. As a result thereof, the material to be discharged can be fed to the A further teaching of the invention provides that the suction box has a nozzle assembly which is preferably directed from the opening toward the connector opening. As a result thereof, the transportation of material within the suction box is improved in a simple manner. Furthermore, the liquefaction of the loosened material is improved so that an improved discharge can take place.

A further teaching of the invention provides that the suction box is provided so as to be replaceable in the drill head. As a result thereof, the drill head can be readily adapted to different geological conditions. Furthermore, a reversal of the rotating direction is also possible.

A further teaching of the invention provides that a classifying element is provided in the opening region. This here can be, for example, a mesh, separators which divide the opening region into a plurality of openings, or else a plurality of openings. As a result thereof, it becomes possible to achieve in a simple manner a limitation in terms of the grain size of the suctioned material.

A further teaching of the invention provides that the suction box is disposed so as to be substantially horizontal. As a result thereof, the transportation of material in the suction box, for example the liquefaction of the material and the pick-up of material, is/are positively influenced. Alternatively, the suction box is disposed so as to be substantially vertical. As a result thereof, the transportation of material is positively influenced by the direct inflow. It has been surprisingly demonstrated that, as a result thereof, the intake is positively influenced because less material accumulates in the region of the opening. Moreover, this construction mode is easier to implement in the drill head. Alternatively, a disposal so as to be inclined between the horizontal and the vertical is also possible.

A further teaching of the invention here provides that the opening region, when viewed from the center, extends in a substantially radially outward manner. It is advantageous here for the opening to be embodied in the manner of a slot. A further teaching of the invention provides here that the available cross section of the opening, when viewed in a radially outward manner, varies along the opening region, preferably increases along the latter. As a result thereof, the pick-up of material, the location of the material pick-up, as well as the picked up quantity can be influenced in a simple manner.

It is furthermore advantageous herein that the connector opening of the suction box in terms of the opening region is disposed so as to be offset, preferably in an outward manner, in relation to a perpendicular bisector of the opening region. As a result thereof, the suction box is of an asymmetrical construction. The suction intensity, or the flow profile, respectively, in the suction box or in the opening region can be influenced in a simple manner so that the suctioned quantity of material is able to be influenced. For example, the flow in that region of the suction box that, when viewed radially, is on the outside can be increased by way of an outward displacement so as to be better able to suction the larger quantity of material arising there.

A further teaching of the invention provides that the connector opening of the suction box in terms of the opening region is disposed so as to be pivoted in relation to a perpendicular bisector of the opening region. The suction intensity, or the flow profile, respectively, in the suction box or in the opening region can be influenced in a simple manner so that the suctioned quantity of material is able to be influenced. For example, the flow in that region of the suction box that, when viewed radially, is on the outside can be increased by way of an inward tilting of the connector opening so as to be better able to suction the larger quantity of material arising there.

A further teaching of the invention provides that nozzles which are preferably directed into the opening region and/or into the opening are provided in the opening region. As a result thereof, the loosened/conveyed material in the opening region can be liquefied in a simple manner so that suctioning takes place into the interior space of the suction box. It is particularly advantageous here that the suction system is dimensioned such that the opening region remains substantially free of loosened/conveyed ground/rock. To this end, sufficient liquid has to be conveyed through the suction box and the conveying line, and the liquefaction of the loosened/conveyed material has to take place in sufficient quantities.

A further teaching of the invention provides that a flow ring which extends toward the face is provided on the external periphery in the region of the opening. In this way, shorting of the flow from the rear side of the drill head toward the opening can be avoided in a simple manner.

A further teaching of the invention provides that, when viewed in the rotating direction of the drill head, at least two nozzles for dispensing a jet of a medium, preferably a liquid or air, are provided in front of the opening on the lower side of the drill head, said nozzles being directed toward the face. There are particularly preferably so many nozzles extending along a longitudinal direction that said nozzles cause a dense jet region. As a result thereof, it has been surprisingly demonstrated that material can be held in a simple manner in the active region of the opening, and/or that a return flow, for example of accelerated material, in the rotating direction can be prevented. Furthermore, releasing the loosened ground from the face and/or accelerating the loosened ground can also take place such that said loosened ground can more easily be suctioned into the opening.

A further teaching of the invention provides that, when viewed in the rotating direction of the drill head, at least two nozzles for dispensing a jet of a medium, preferably a liquid or air, are provided behind the opening on the lower side of the drill head, said nozzles being directed toward the face. There are particularly preferably so many nozzles extending along a longitudinal direction that said nozzles cause a dense jet region. As a result thereof, releasing the loosened ground from the face and/or accelerating the loosened ground can take place in a simple manner such that said loosened ground can more easily be suctioned into the opening. Furthermore, it has been surprisingly demonstrated that material can be held in a simple manner in the active region of the opening, and/or that exiting, for example of accelerated material, counter to the rotating direction can be prevented. The proportion of loosened ground which has not been suctioned and is then reprocessed by the drilling tools of the drill head can furthermore be reduced.

A further teaching of the invention provides that the direction of the jet corresponds to a vector which, proceeding from the nozzle, has one directional component toward the face and/or one directional component toward the opening.

A further teaching of the invention provides that the jets of the at least two nozzles have the effect of a blocking action in relation to the loosened ground moving counter to the rotating direction of the drill head, and/or releasing the loosened ground from the face and/or accelerating the loosened ground.

A further teaching of the invention provides that the jets of the at least two nozzles have the effect of a blocking action in relation to the loosened ground moving in the rotating direction of the drill head, and/or releasing the loosened ground from the face and/or accelerating the loosened ground.

When rows of nozzles are provided in front of and behind the opening, it is advantageous for those nozzles that are disposed in the rotating direction in front of the opening to have a smaller directional component toward the opening and/or a larger spacing from the opening than the nozzles disposed behind the opening. The aforementioned advantages are amplified as a result thereof.

A further teaching of the invention provides that at least one nozzle for dispensing a jet of a medium, preferably a liquid or air, is provided on the lower side of the drill head, and in that the jet has the effect of moving the loosened ground into a region of the face which during rotation of the drill head is traversed by the opening. As a result thereof, controlling the distribution of the material of the loosened ground can surprisingly be effected in a simple manner such that no overloading arises in specific regions of the intake opening.

A further teaching of the invention provides that the jet impacts a baffle, as a result of which a change in the moving direction of the loosened ground is effected, and in that the baffle is disposed as a straight or curved element on the lower side of the drill head, and in that the disposal is diagonal or at least partially circumferential. The distribution of material is facilitated as a result thereof.

A further teaching of the invention provides that at least one nozzle, preferably at least two nozzles which are aligned so as to be mutually opposed, are provided in the center of the lower side of the drill head. It has been demonstrated that, as a result thereof, the loosened ground is able to be removed in a simple manner from the center, the latter not being able to be traveled across constructively by the intake opening.

A further teaching of the invention provides that at least one nozzle, preferably at least two nozzles, are provided so as to be tangentially aligned on the lower side of the drill head. As a result thereof, the loosened ground from the outer region, the latter not being able to be readily traveled across constructively by the intake opening, can be diverted in a simple manner into a region in which suctioning takes place. This is preferably also supported by a combination of the aforementioned baffles.

A further teaching of the invention provides that radially adjustable peripheral cutting tools are provided.

The object according to the invention according to a second solution according to the invention is achieved in that, when viewed in the rotating direction of the drill head, at least two nozzles for dispensing a jet of a medium, preferably a liquid or air, are provided in front of the opening on the lower side of the drill head, said nozzles being directed toward the face. There are particularly preferably so many nozzles extending along a longitudinal direction that said nozzles cause a dense jet region. As a result thereof, it has been surprisingly demonstrated that material can be held in a simple manner in the active region of the opening, and/or that a return flow, for example of accelerated material, in the rotating direction can be prevented. Furthermore, releasing the loosened ground from the face and/or accelerating the loosened ground can also take place such that said loosened ground can more easily be suctioned into the opening.

A further teaching of the invention provides that, when viewed in the rotating direction of the drill head, at least two nozzles for dispensing a jet of a medium, preferably a liquid or air, are provided behind the opening on the lower side of the drill head, said nozzles being directed toward the face. There are particularly preferably so many nozzles extending along a longitudinal direction that said nozzles cause a dense jet region. As a result thereof, releasing the loosened ground from the face and/or accelerating the loosened ground can take place in a simple manner such that said loosened It is furthermore advantageous that the third solution according to the invention is combined with further features mentioned above in the context of the first and/or the second solution according to the invention.

BRIEF DESCRIPTION OF THE DRAWINGS

The invention will be explained in more detail hereunder by means of exemplary embodiments in conjunction with a drawing. In the drawing:

FIGS. 20 to 32 show views and details pertaining to a third embodiment of a drill head according to the invention.

In the figures pertaining to the first embodiment:

FIG. 1 shows a three-dimensional view of the lower side of the drill head of the first embodiment according to the invention;

FIG. 2 shows a lateral view of FIG. 1;

FIG. 3 shows a plan view of the lower side of FIG. 1;

FIG. 4 shows a plan view of the upper side of FIG. 1;

FIG. 5 shows a three-dimensional view of a first embodiment of a suction box according to the invention;

FIG. 6 shows a front view of FIG. 5;

FIG. 7 shows a lower view of FIG. 5;

FIG. 8 shows a three-dimensional illustration of the lower view of FIG. 7;

FIG. 9 shows a partially sectional lateral view of FIG. 5, having a deployed cleaning element;

FIG. 10 shows a view analogous to that of FIG. 9, having a retracted cleaning element;

FIG. 11 shows a three-dimensional downward-tilted front view of FIG. 5.

In the figures pertaining to the second embodiment:

FIG. 12 shows a three-dimensional view of the lower side of the drill head of the second embodiment according to the invention;

FIG. 13 shows a lateral view of FIG. 12;

FIG. 14 shows a plan view of the lower side of FIG. 12;

FIG. 15 shows a plan view of the upper side of FIG. 12;

FIG. 16 shows a plan view of a second embodiment of a suction box according to the invention;

FIG. 17 shows a lower view of FIG. 16;

FIG. 18 shows a partially sectional side view of FIG. 16 along the line A-A;

FIG. 19 shows an enlarged fragment of FIG. 18.

In the figures pertaining to the third embodiment:

FIG. 20 shows a plan view of the lower side of the drill head of the third embodiment according to the invention;

FIG. 21 shows a plan view of the upper side of FIG. 12;

FIG. 22 shows FIG. 20 having material conveying regions illustrated;

FIG. 24 shows a sectional view through a suction region according to the invention;

FIG. 25 shows a lateral view of a third embodiment of a suction box according to the invention;

FIG. 26 shows a first sectional view of FIG. 25 seen in the direction of the width of the suction box;

FIG. 27 shows a three-dimensional view of FIG. 25;

FIG. 28 shows a plan view of FIG. 25;

FIG. 29 shows a second sectional view of FIG. 25, seen transversely to FIG. 26;

FIG. 30 shows an enlarged partial fragment of FIG. 20, having a deployed peripheral cutting tool;

FIG. 31 shows the peripheral cutting tool of FIG. 30 in the retracted state; and FIG. 32 shows the peripheral cutting tool of FIG. 30 in the emergency state.

DETAILED DESCRIPTION

Figure 1:
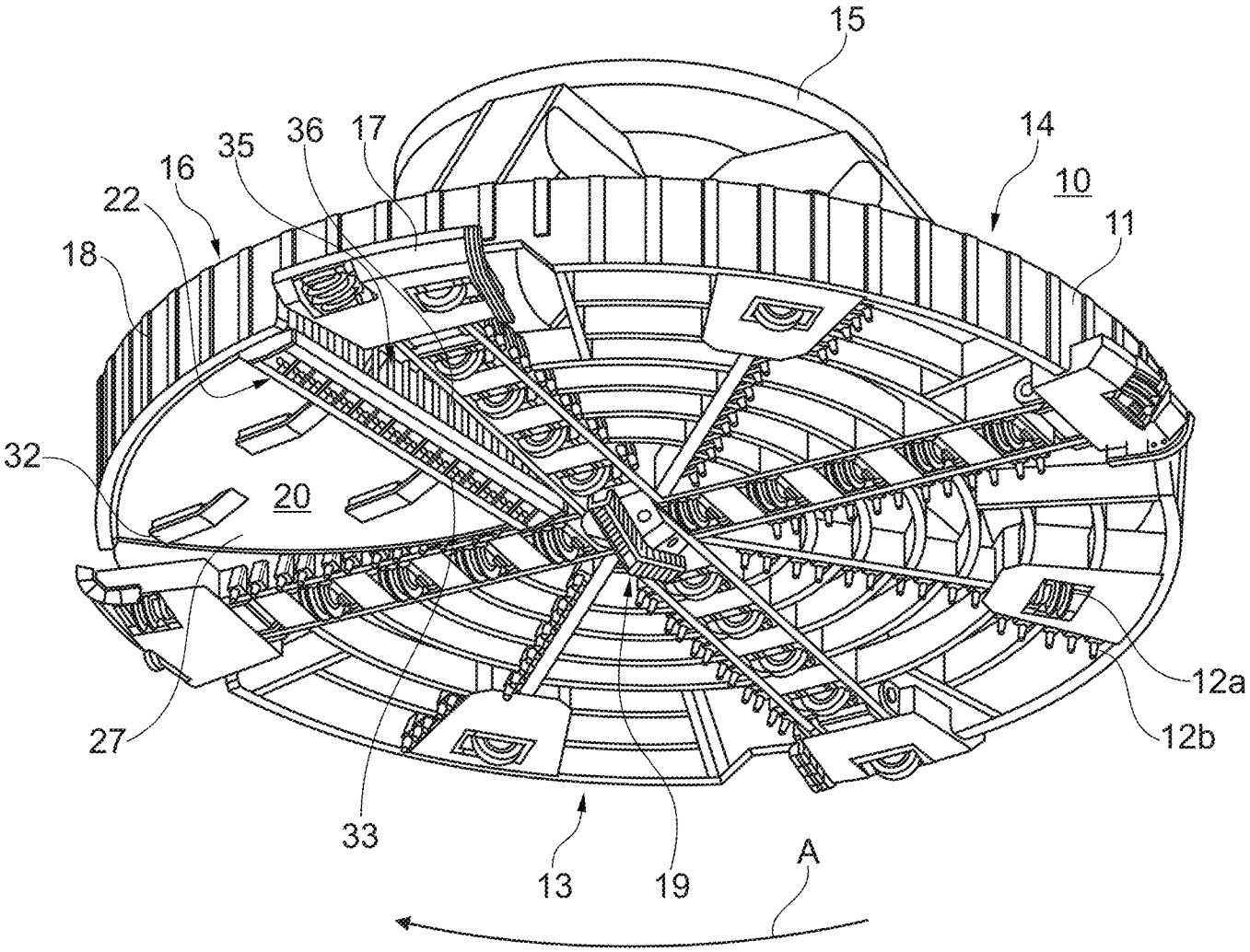
FIGS. 1 to 11 show views and details pertaining to a first embodiment of a drill head according to the invention.
Figure 2:
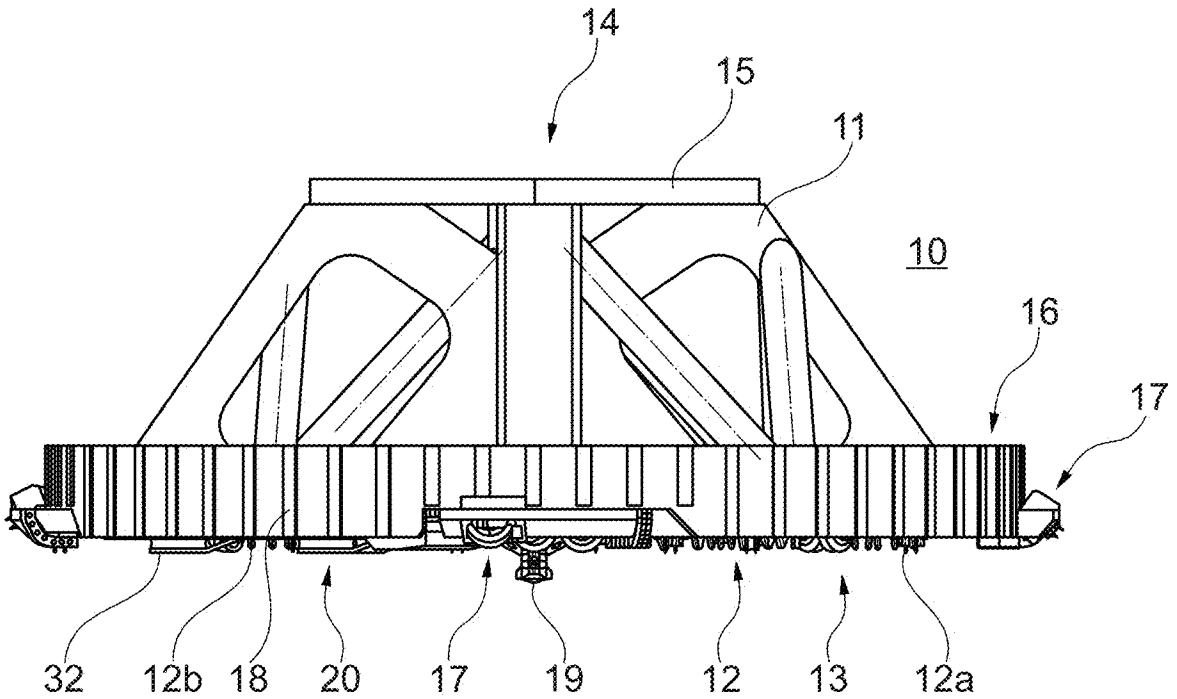
Figure 3:
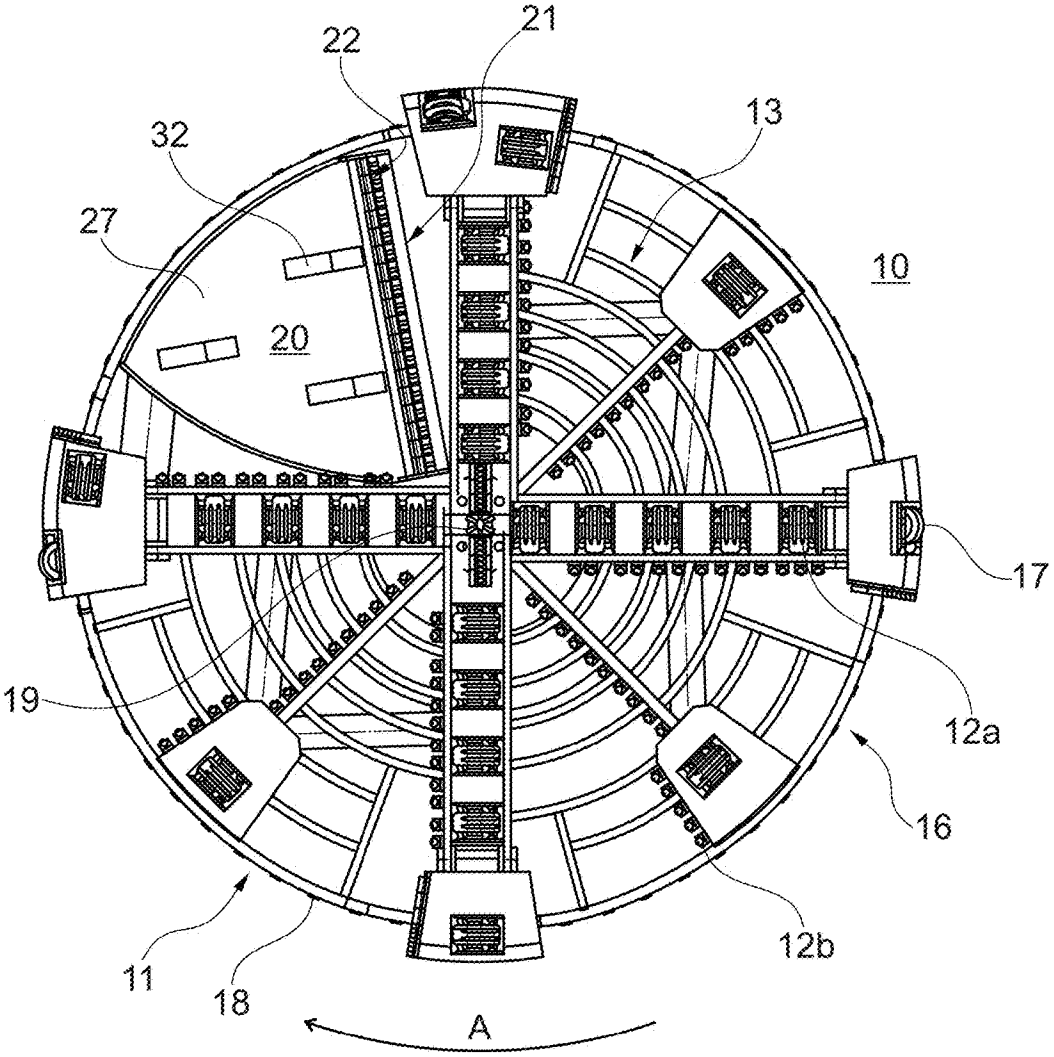
Figure 4:
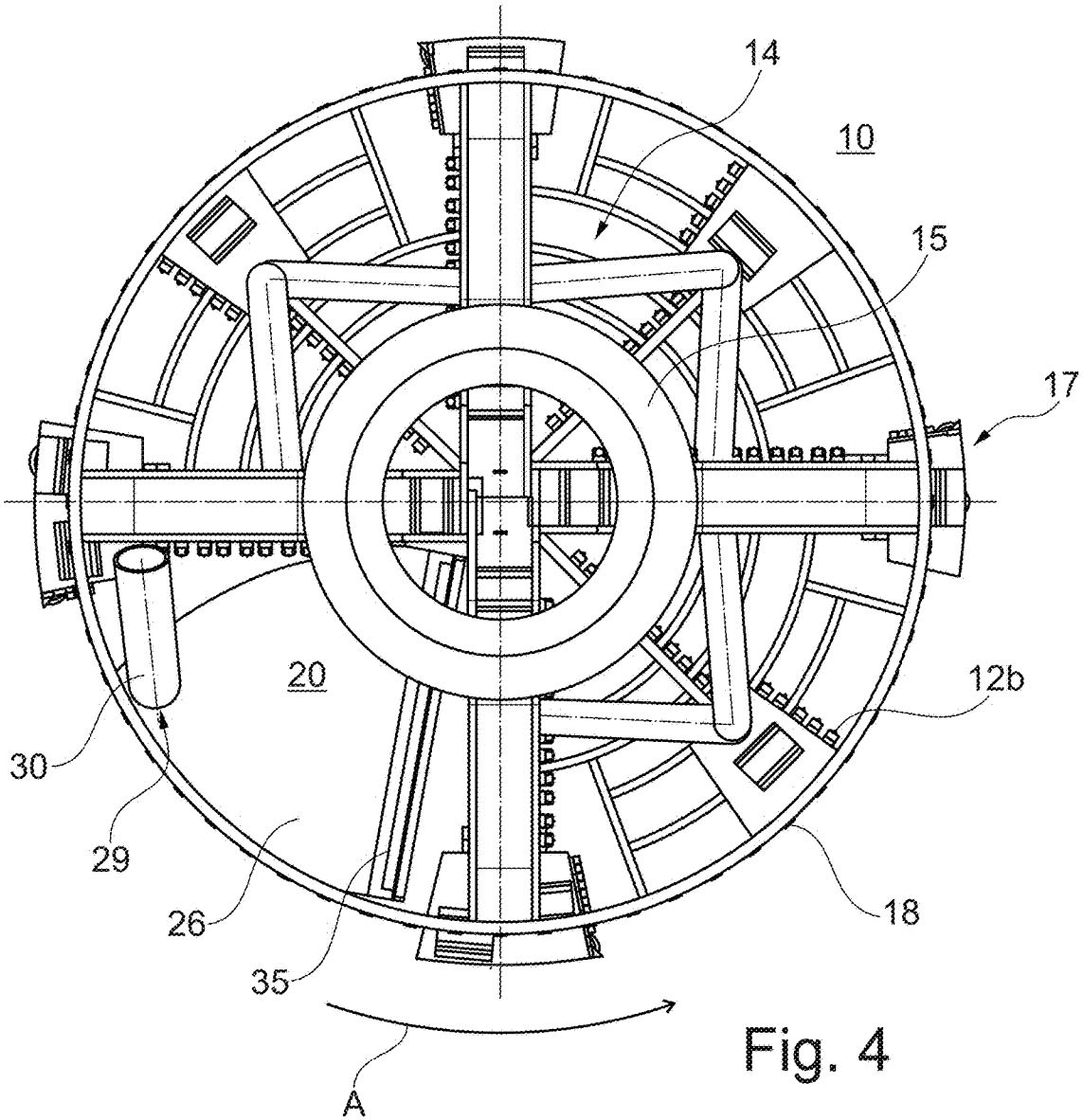

FIG. 1 to FIG. 4 in a three-dimensional illustration show a drill head 10 according to the invention in a first embodiment. The drill head 10 has a body 11, drilling tools 12 being disposed on the lower side 13 thereof. The drill head 10 on the upper side 14 thereof has a connector 15 for a drive (not illustrated) of a drill device (not illustrated). The drive, not illustrated, here is provided directly in the drilling device, for example, the latter being disposed in a casing tube (not illustrated) or in a pile (not illustrated), for example. A further, not final, alternative can also be a top drive which is provided pile on a casing tube or on a pile and by way of which the drill head 10 is connected by way of a stem.

Further variants of drives, drill devices and assemblies in a borehole/pile are likewise possible. Alternatively, the use of the drill head in conjunction with a shaft drilling machine is also possible.

A In order to enable undercuts below a casing tube or a pile, for example, the body 11 on the circumference 16 thereof can have deployable peripheral cutting tools 17 which are illustrated as deployed in FIG. 1 Furthermore provided in an exemplary manner on the circumference 16 on the body 11 are consumable elements 18.

The drilling tools 12 can be, for example, chisel disks 12*a*, peeling chisels 12*b*, or roller chisels 12*c*. The selection of the drilling tools 12 takes place as a function of the ground/rock to be loosened in order for the borehole to be established. Illustrated here are chisel disks 12*a* and peeling chisels 12*b*.

A centering drilling tool 19 which enables centering of the drill head 10 is likewise provided here in the center of the lower side 13, for example.

In a first embodiment, the body 11 on the lower side 13 thereof furthermore has a suction box 20. The suction box 20 is illustrated in detail in FIGS. 5 to 11. Said suction box 20 on the front side 21 thereof has an opening region 22 which has at least one opening 23.

The opening 23 of the first embodiment of the suction box 20 has a classifying element 24 which subdivides the opening 23 into opening portions 23*a*. The grain size of the loosened ground/rock that can enter the interior space 25 of the suction box 20 is determined by the classifying element 24.

The interior space 25 is formed by a lid 26 as the upper side and a base 27 as the lower side, said lid 26 and said base 27 as one embodiment here being embodied in a planar manner. Other shapes of lids and bases are likewise possible. The suction box 20 furthermore has lateral walls 28, the latter here from the front side 21 extending along the shape of the lid and of the base.

As a consequence of the shape of the lid 26, of the base 27 and of the lateral walls 28, a funnel is preferably configured, for example, in that the width BB of the interior space 25 decreases as a result of the curved shape of the lateral walls 28, as a result of which the velocity of the flow of the suctioned mixture composed of the loosened ground/rock and the carrier medium increases as the width BB decreases.

An opening 29 on which a connector 30 for a conveying line 31 is provided, which line during the drilling operation is connected to a pump (not illustrated) so as to perform the discharge of the loosened ground/rock, or of the mixture composed of the conveying medium and the loosened ground/rock, is provided on the rear side of the interior space 25.

In the context of the first embodiment of the suction box 20 according to the invention, the height HH of the interior space 25, proceeding from the front side 21 toward the opening 29 on the rear side of the suction box 20 can additionally be varied (not illustrated), in particular enlarged so as to counteract blockages of the interior space 25 by loosened ground/rock.

Furthermore, it is likewise possible for the suction box 20, here illustrated as symmetrical, to be embodied asymmetrically in that the opening 29 is disposed so as to be laterally offset, for example (not illustrated). It is particularly expedient here for the opening 29 to be disposed so as to be offset toward the circumference 16 of the body 11 so as to adapt the flow profile, for example so as to increase in a targeted manner the flow velocity in regions of the interior space 25, in those regions in which more ground/rock is loosened in the rotation in the rotating direction A and enters the interior space 25 of the suction box 20 through the opening 23.

Figure 5:
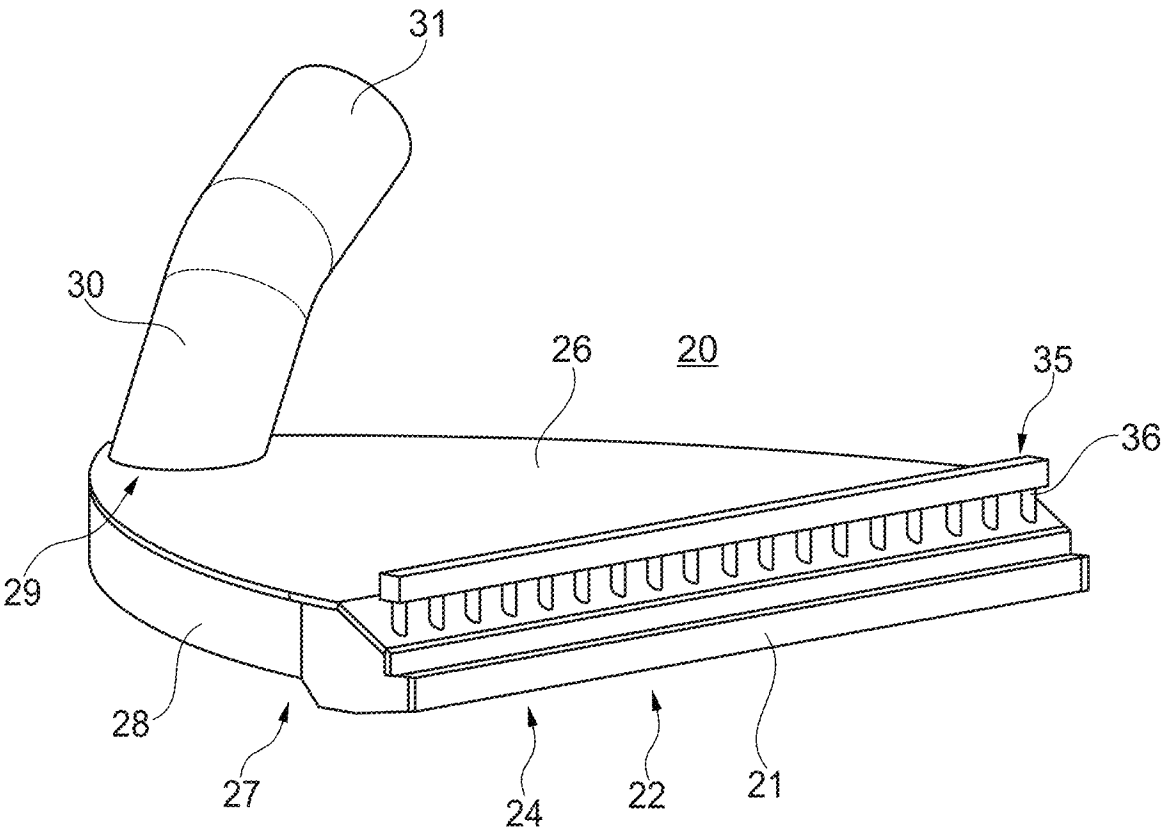
Figure 6:
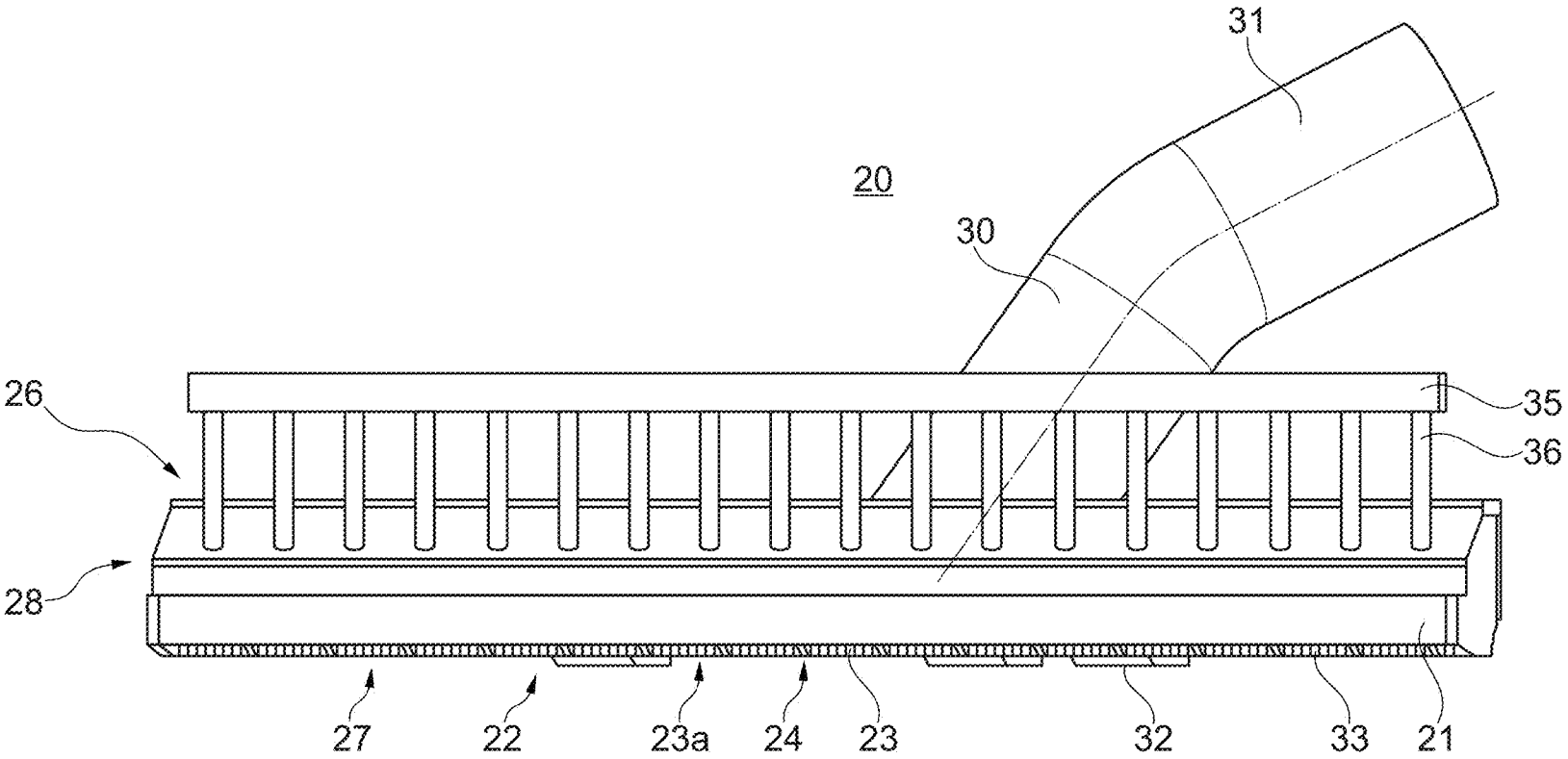
Figure 7:
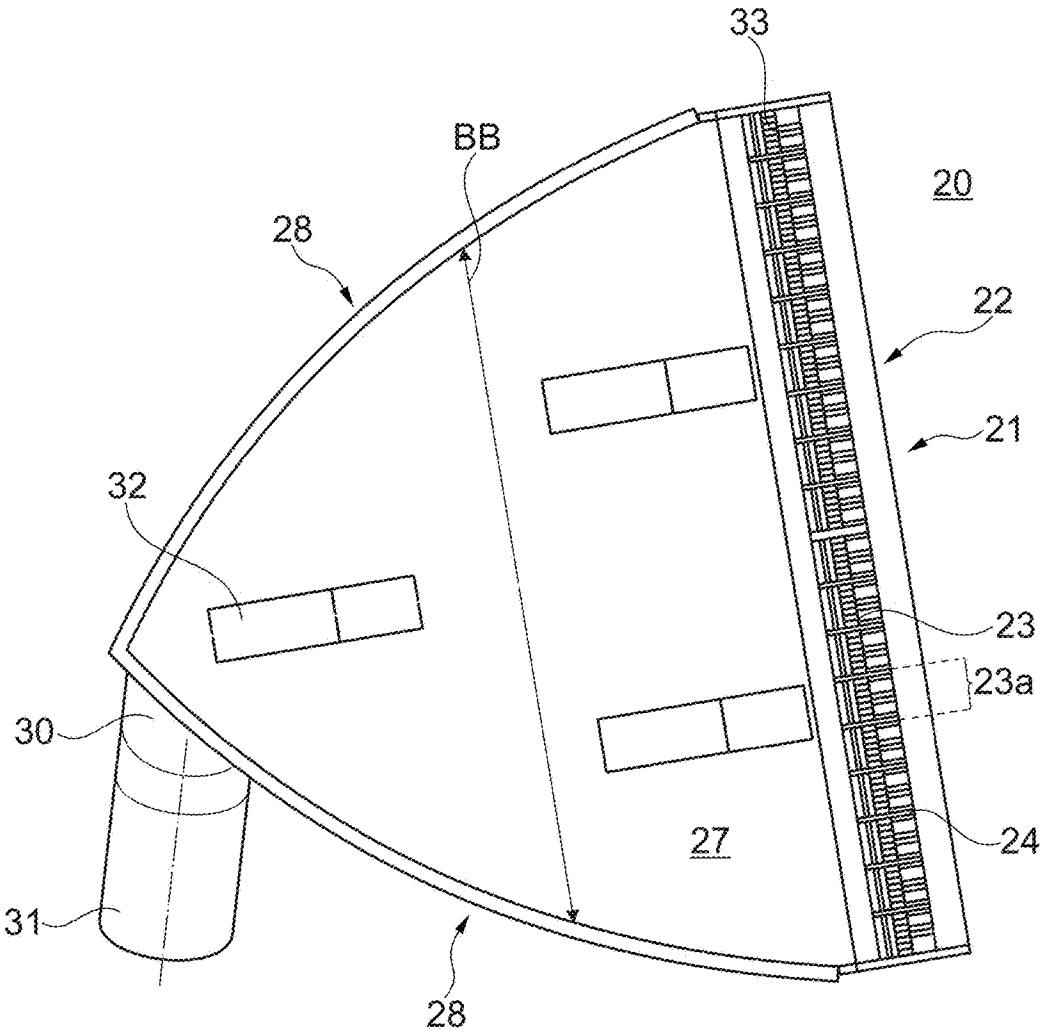
Figure 8:
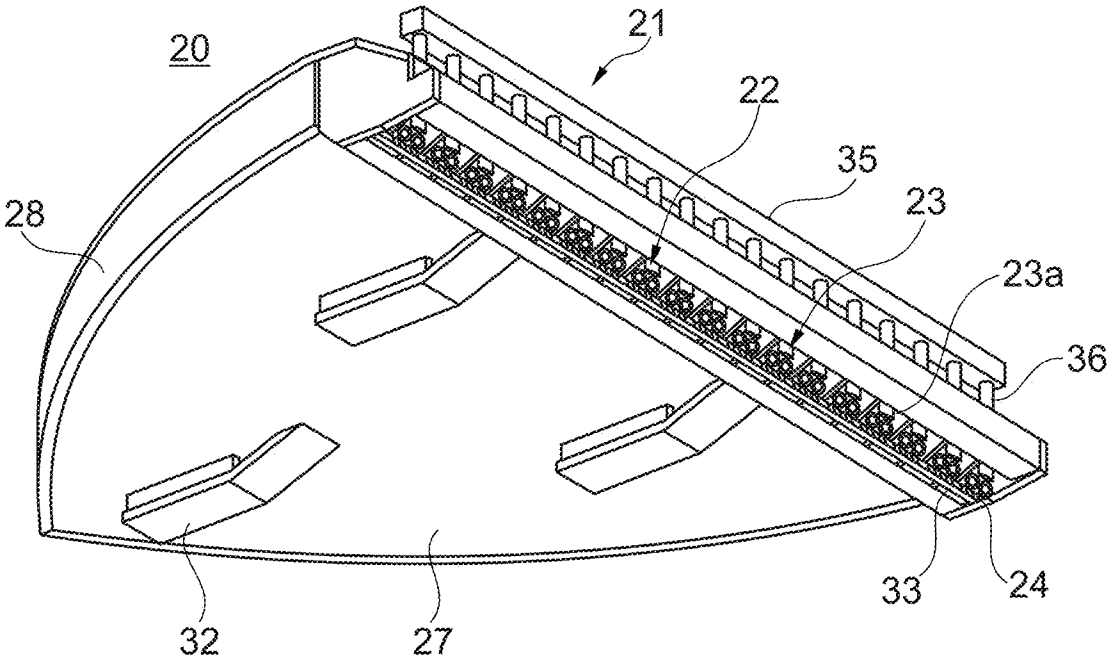
Figure 9:
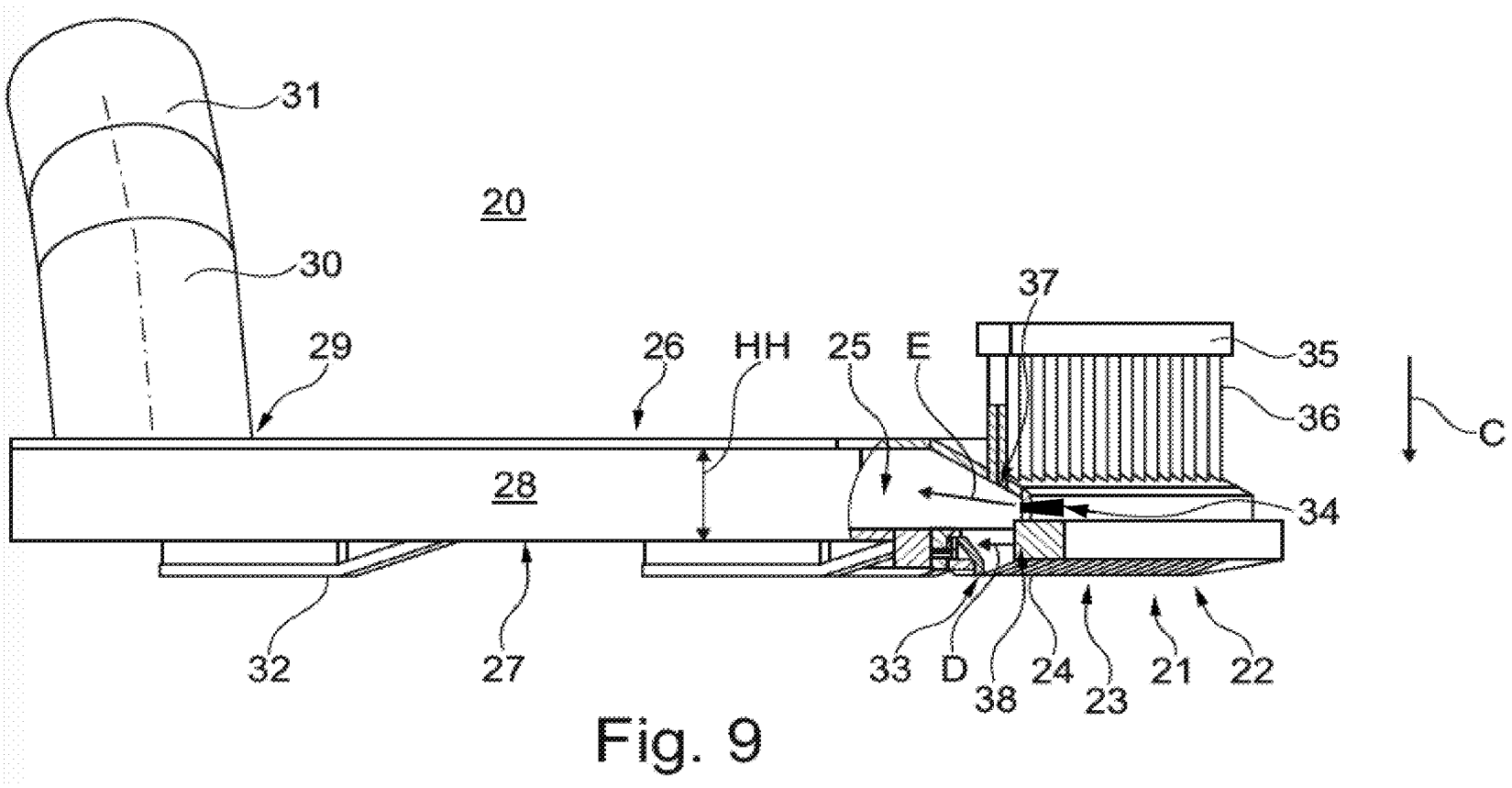
Figure 10:
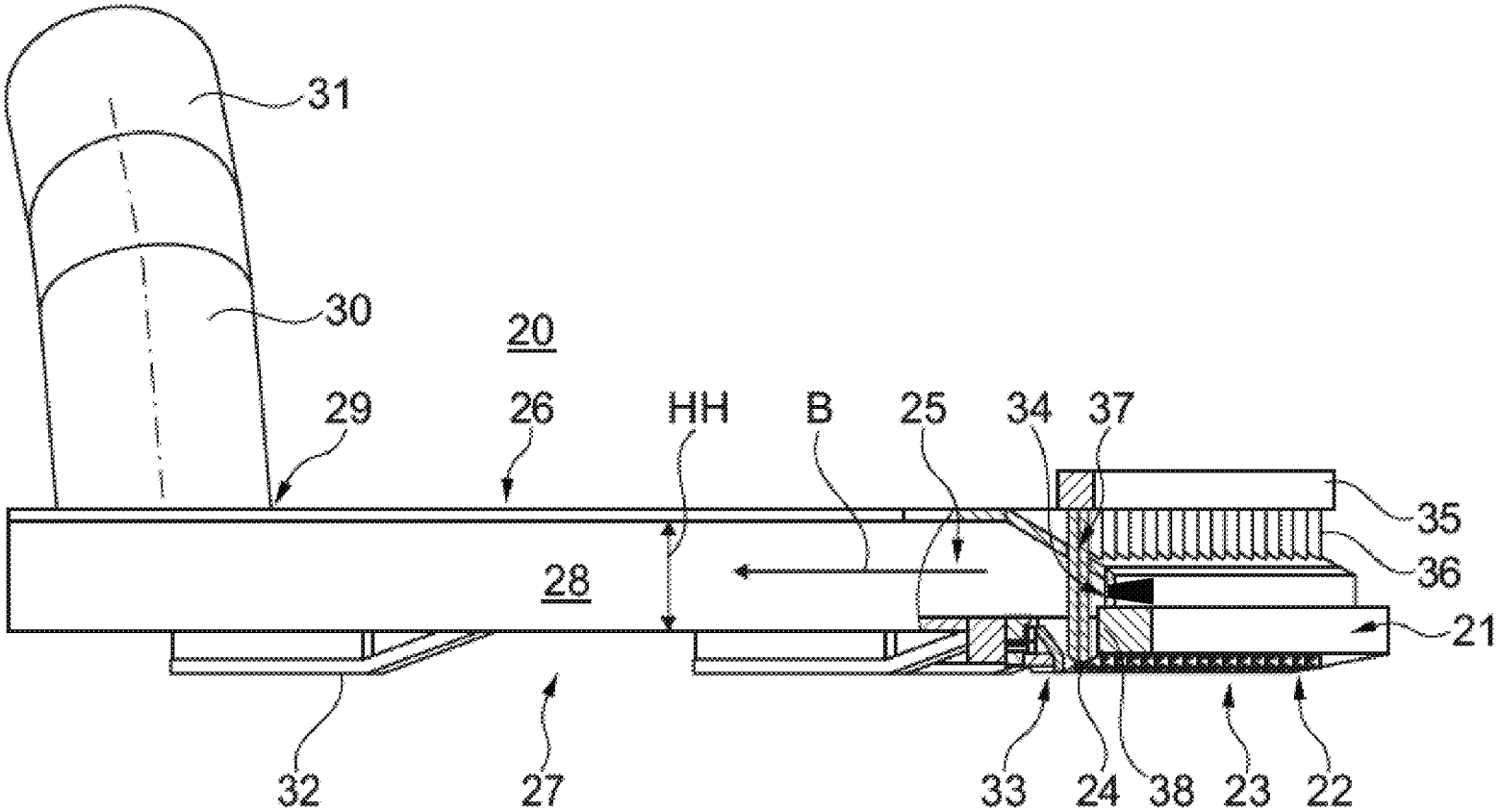
Figure 11:
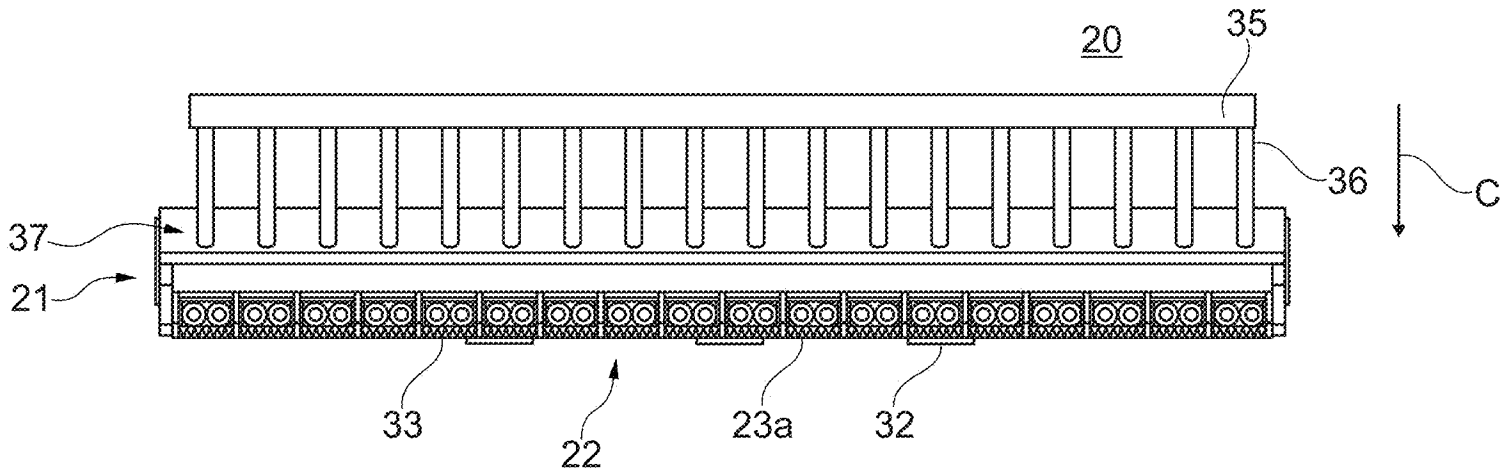
Figure 12:
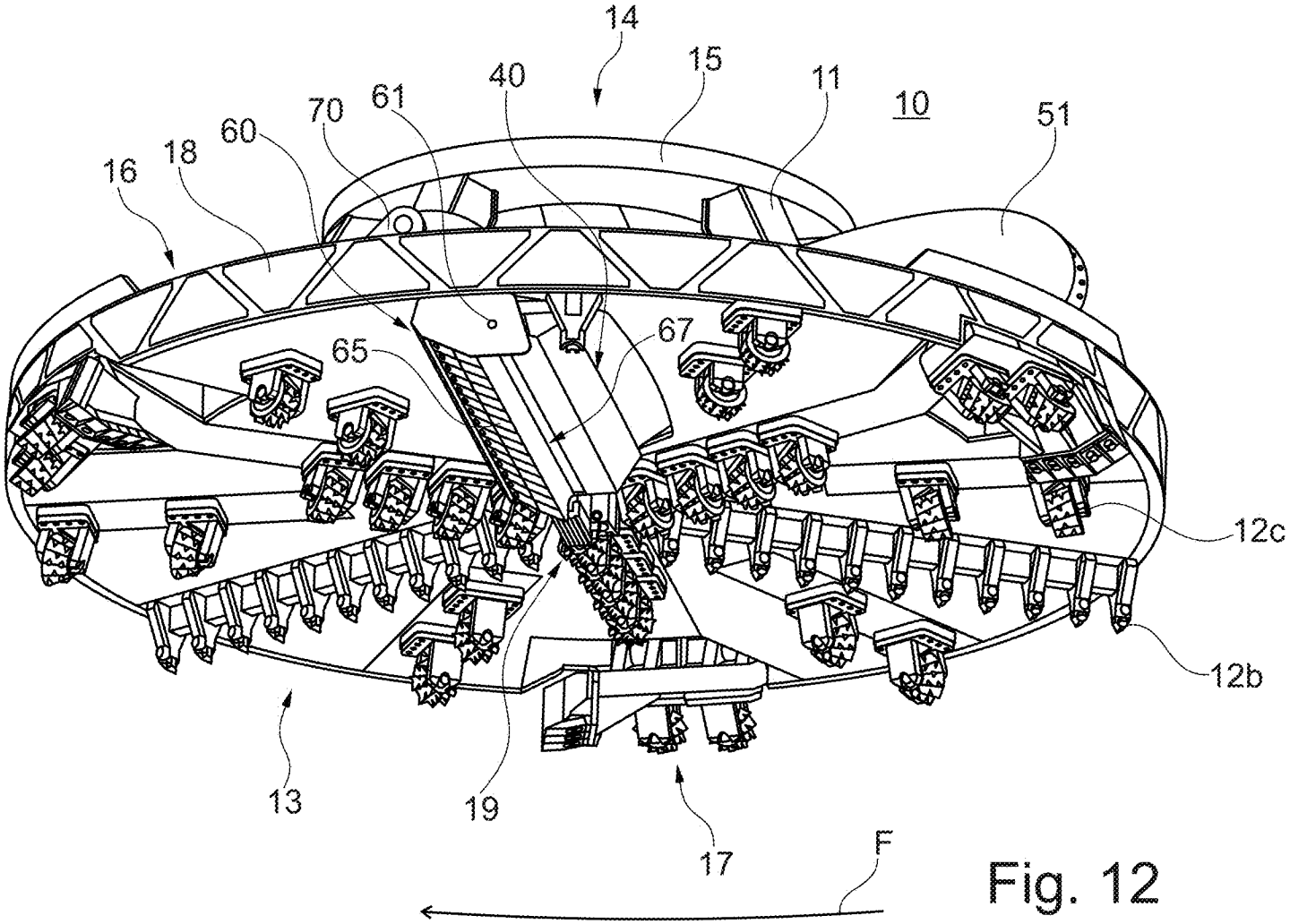
FIGS. 12 to 19 show views and details pertaining to a second embodiment of a drill head according to the invention.
Figure 13:
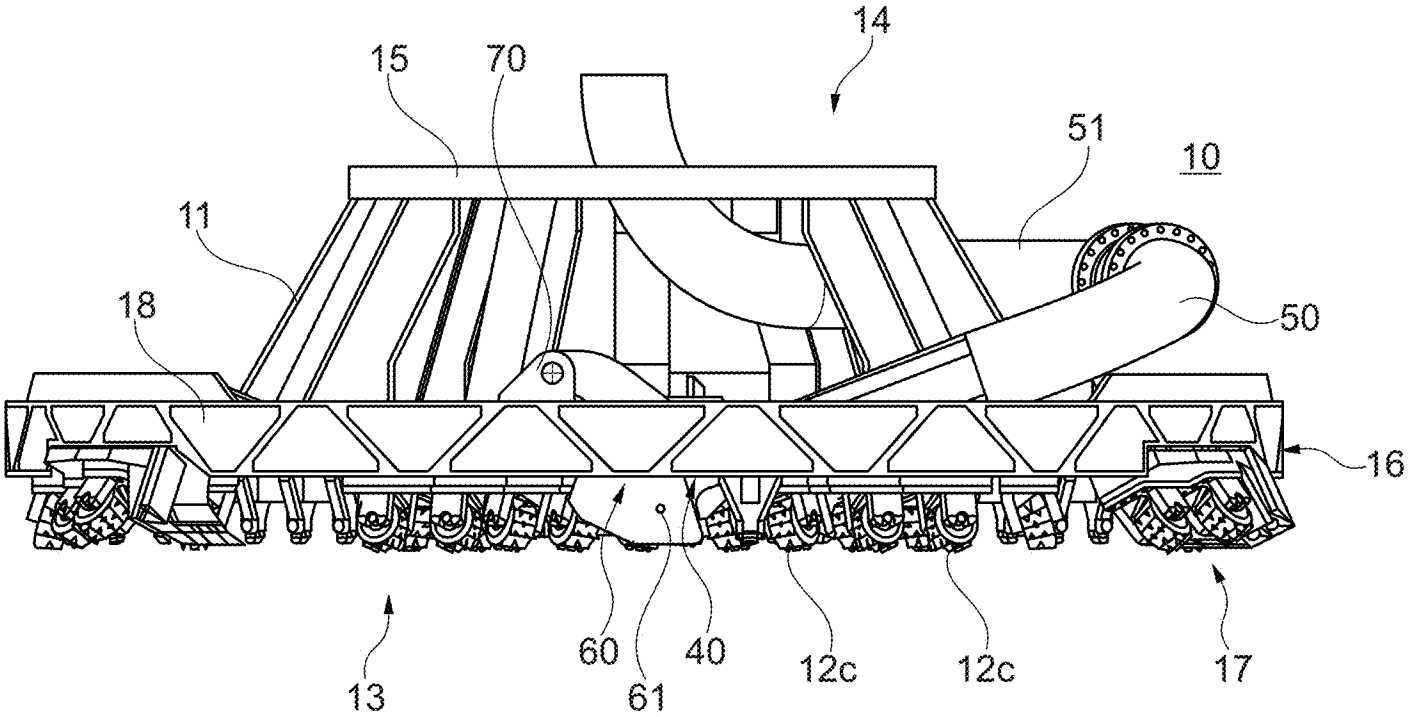
Figure 14:
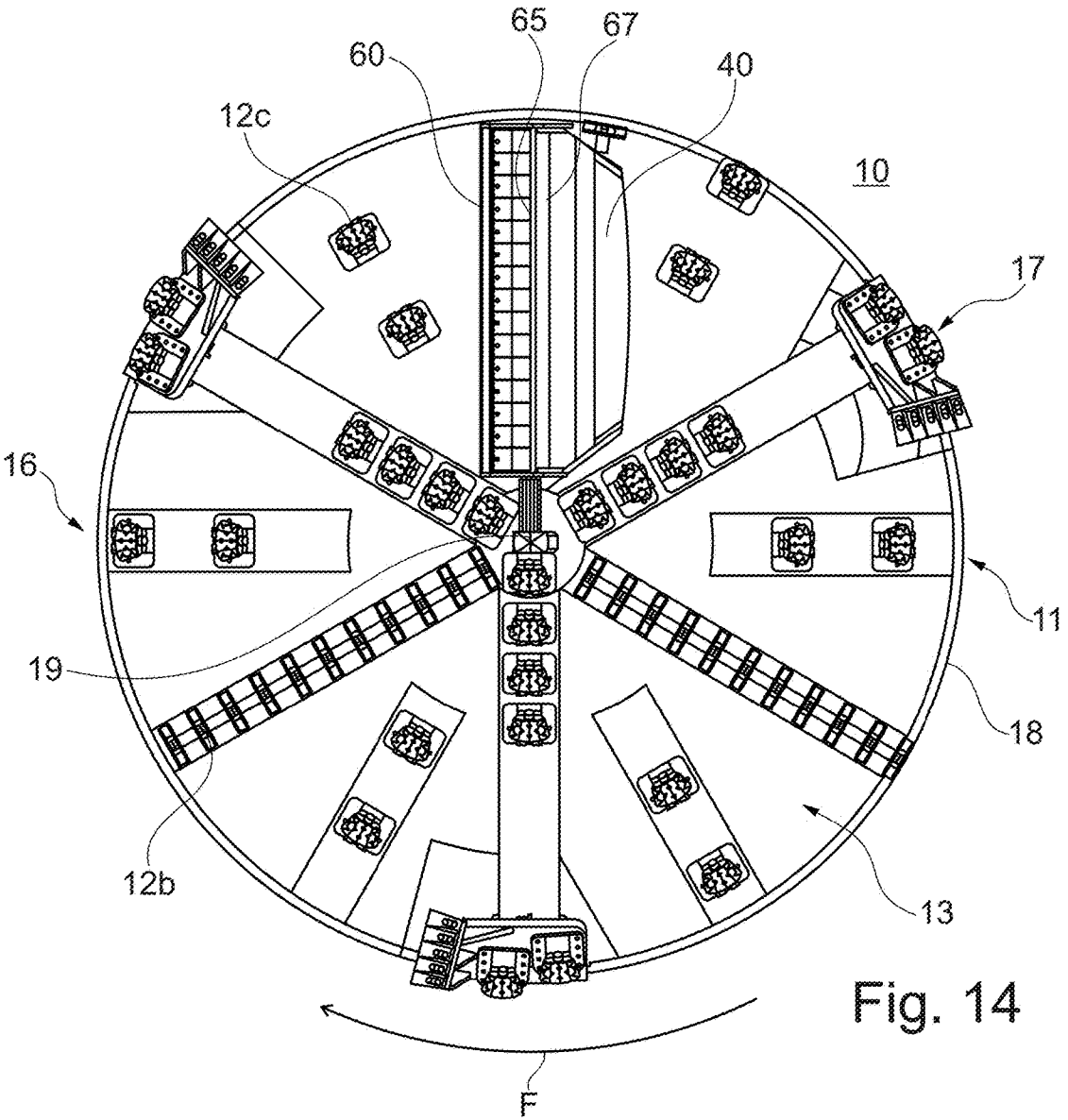
Figure 15:
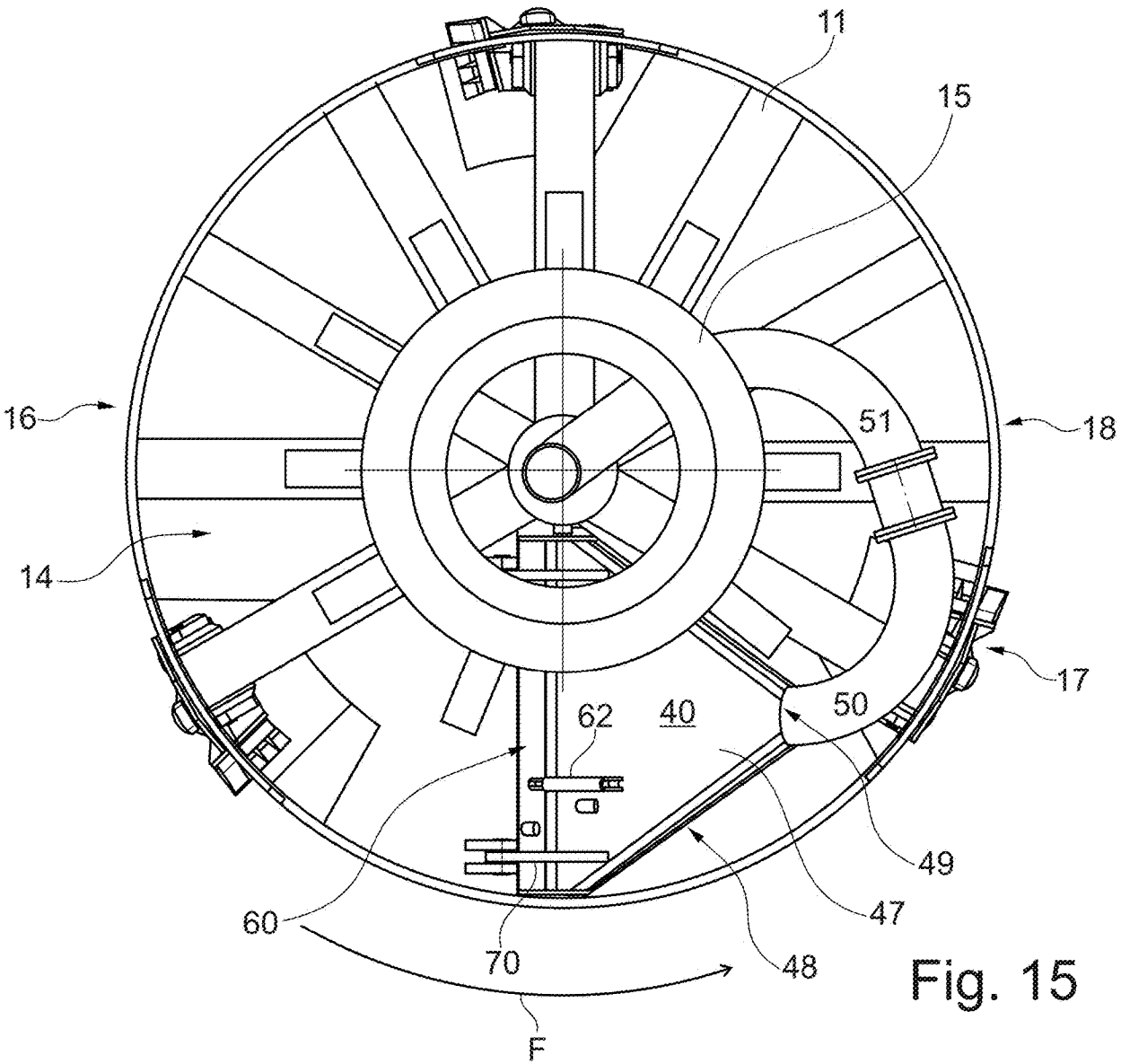

The same is also possible in that the connector 30 of the conveying line 31 opens into the interior space 25 so as to be inclined into the latter, as is illustrated in FIG. 5, for example.

Friction elements 32 which enable that the suction box 20 during drilling, or rotating in the rotating direction A, respectively, can slide on the face, or at a defined spacing from the latter, respectively, are disposed on the lower side of the base 27.

The opening region 22 including the opening 23, the latter extending along the front side 21, has ground loosening tools 33, here a peeling blade, for example. As a result of the ground loosening tools 33 it is possible for ground/rock in the region of the front side 21 of the suction box 20 to be loosened or picked up in a targeted manner and to be supplied to the opening 23, discharging then taking place in the latter.

Additionally or alternatively, baffles (not illustrated), in order for the loosened material that is not directly suctioned in the flow direction B by the flow to be supplied to the opening region 22 and then for said material to be suctioned through the openings 23 into the interior 25, can also be provided.

Above the openings 23, nozzles 34 are disposed on the front side 21 (see in an exemplary manner FIG. 9), said nozzles 34 being directed in the direction B of the opening 29 and dispensing from a carrier medium, for example a liquid or air, a jet in a direction E into the interior space 25 so that material which is situated in the interior space 25 is moved in the direction B to the opening 29. Furthermore, accumulations of loosened material can also be dissolved by the jets dispensed by the nozzles 34. When dispensing a liquid, the latter can be used, for example, or alternatively also for liquefying the loosened/conveyed material in the suction box 20 and/or the opening region 22, and thus for guaranteeing improved discharging. The conveying flow in the conveying line 31 and/or the liquefaction here are/is advantageously conceived such that the loosened/conveyed material does not back up in the opening region 22, but the opening region 22 remains substantially vacant.

A cleaning element 35 is additionally provided in the opening region 22. The cleaning element 35 has rods 36 which are guided in passages 37 such that, when the rods 36 are moved in the cleaning direction C, the rods engage in the opening portions 23*a* of the openings 23, or in the classifying elements 24 provided therein, respectively, and remove deposited material therefrom and thus render the openings 23 passable again. The cleaning element 35 is subsequently moved out of the opening portions 23*a* again counter to the direction of the arrow C. Alternatively, nozzles 38 which in the cleaning direction D dispense liquid jets for cleaning, as is illustrated in an exemplary manner in FIG. 9, can also be provided for cleaning the openings or the classifying elements 24. When dispensing a liquid, the latter can be used, for example, or alternatively also for liquefying the loosened/conveyed material in the suction box 20 and/or the opening region, and thus for guaranteeing improved discharging. The conveying flow in the conveying line 31 and/or the liquefaction here are/is advantageously conceived such that the loosened/conveyed material does not back up in the opening region 22, but the opening region 22 remains substantially vacant.

FIG. 12 to FIG. 15 in a three-dimensional illustration show a drill head 10 according to the invention in a second embodiment. The drill head 10 has a body 11, drilling tools 12 being disposed on the lower side 13 thereof. The drill head 10 on the upper side 14 thereof has a connector 15 for a drive (not illustrated) of a drill device (not illustrated). The drive, not illustrated, here is provided directly in the drilling device, for example, the latter being disposed in a casing tube (not illustrated) pile or in a pile (not illustrated), for example. A further, not final, alternative can also be a top drive which is provided on a casing tube or on a pile and by way of which the drill head 10 is connected by way of a stem. Further variants of drives, drill devices and assemblies in a borehole/pile are likewise possible. Alternatively, the use of the drill head in conjunction with a shaft drilling machine is also possible.

In order to enable undercuts below a casing tube or a pile, for example, the body 11 on the circumference 16 thereof can have deployable peripheral cutting tools 17 which are illustrated as deployed in FIG. 1. Furthermore provided in an exemplary manner on the circumference 16 on the body 11 are consumable elements 18.

The drilling tools 12 can be, for example, chisel disks 12*a*, peeling chisels 12*b*, or roller chisels 12*c*. The selection of the drilling tools 12 takes place as a function of the ground/rock to be loosened in order for the borehole to be established. Illustrated here are chisel disks 12*c* and peeling chisels 12*b*.

A centering drilling tool 19 which enables centering of the drill head 10 is likewise provided here in the center of the lower side 13, for example.

Figure 16:
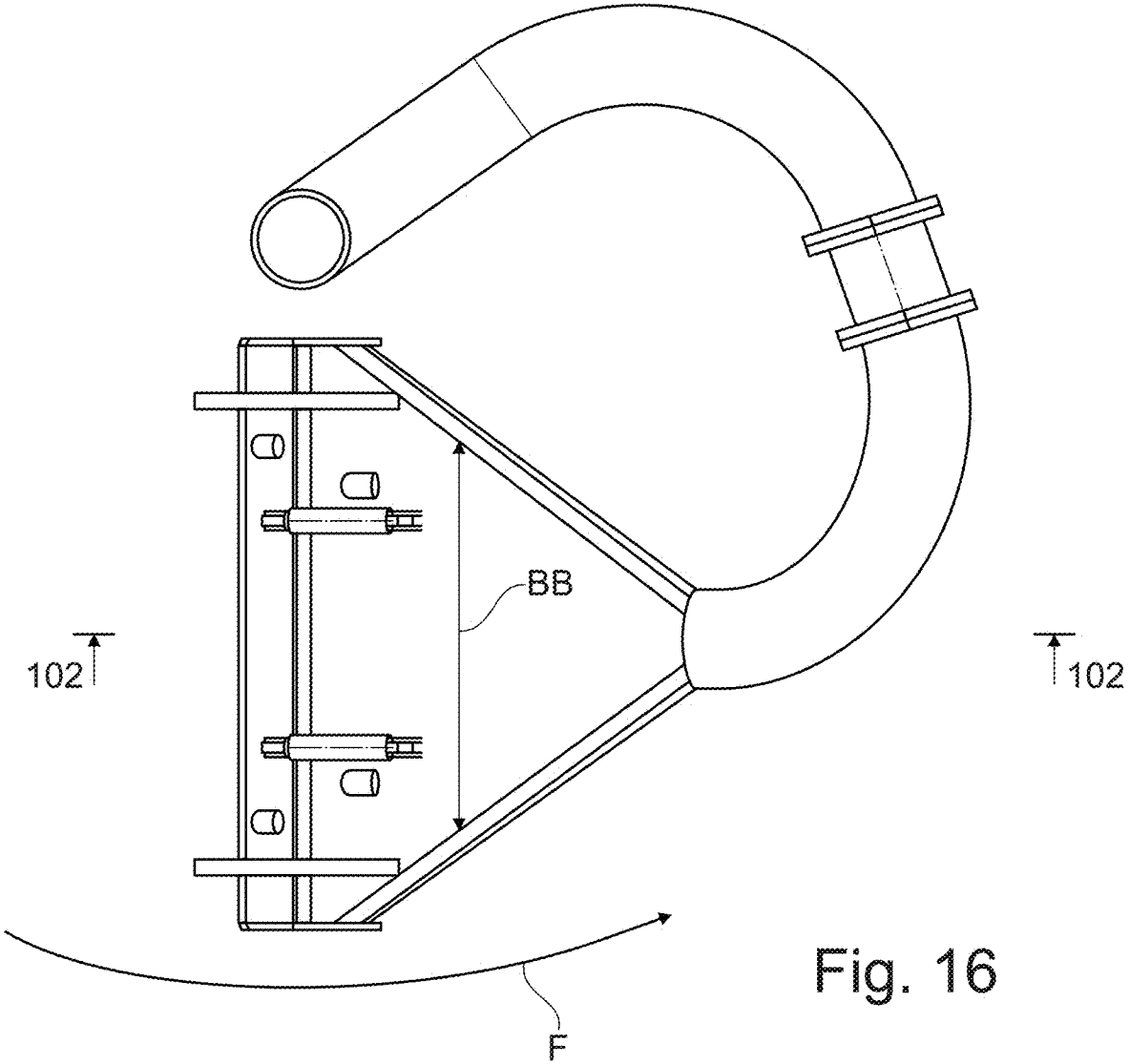
Figure 17:
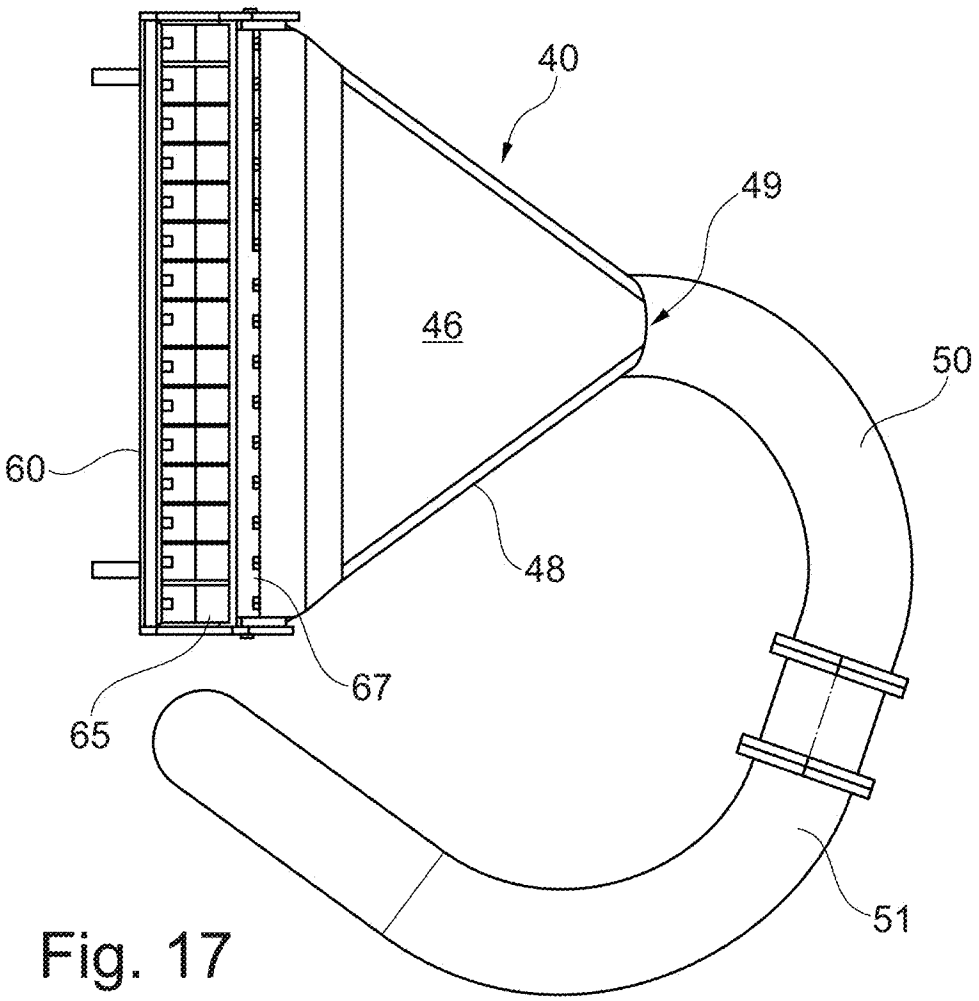
Figure 18:
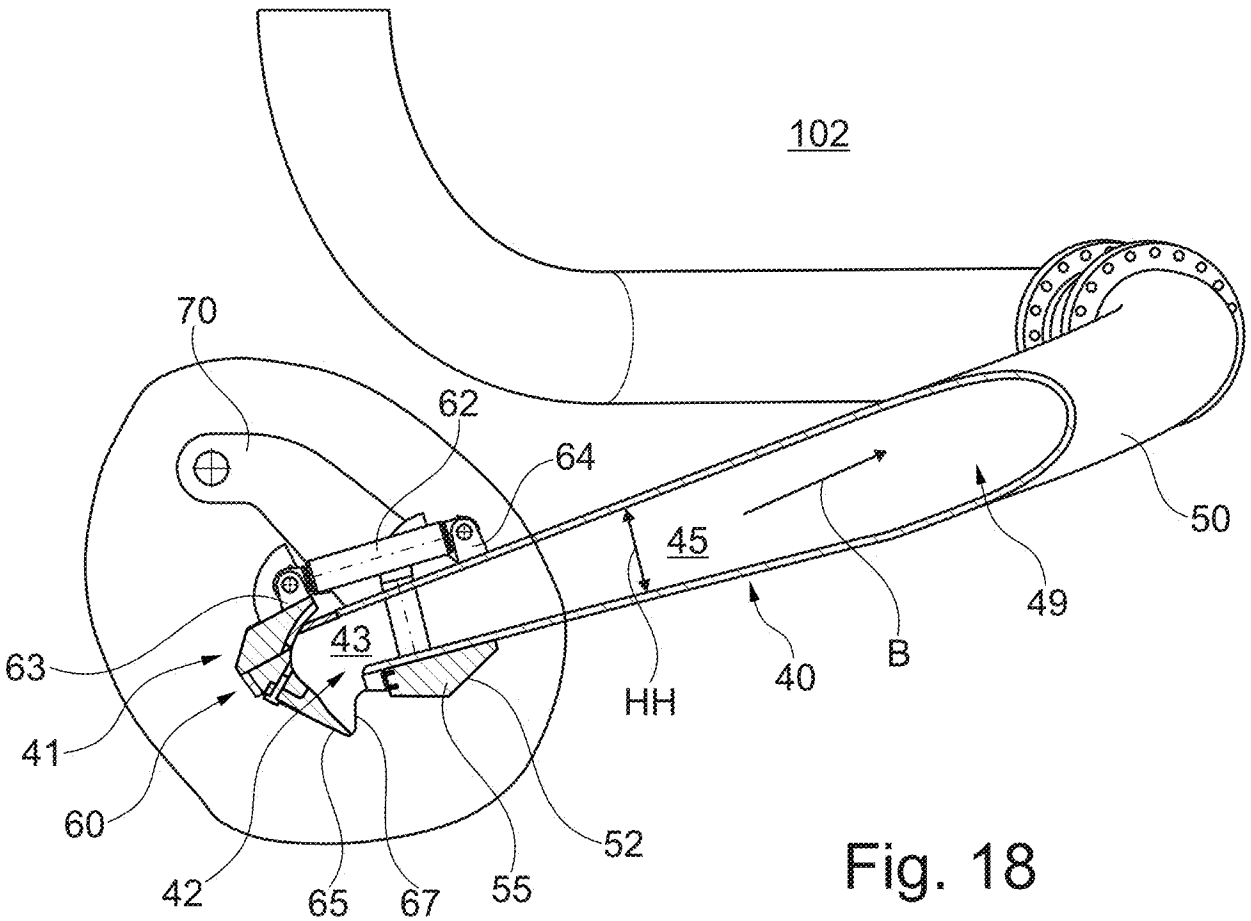
Figure 19:
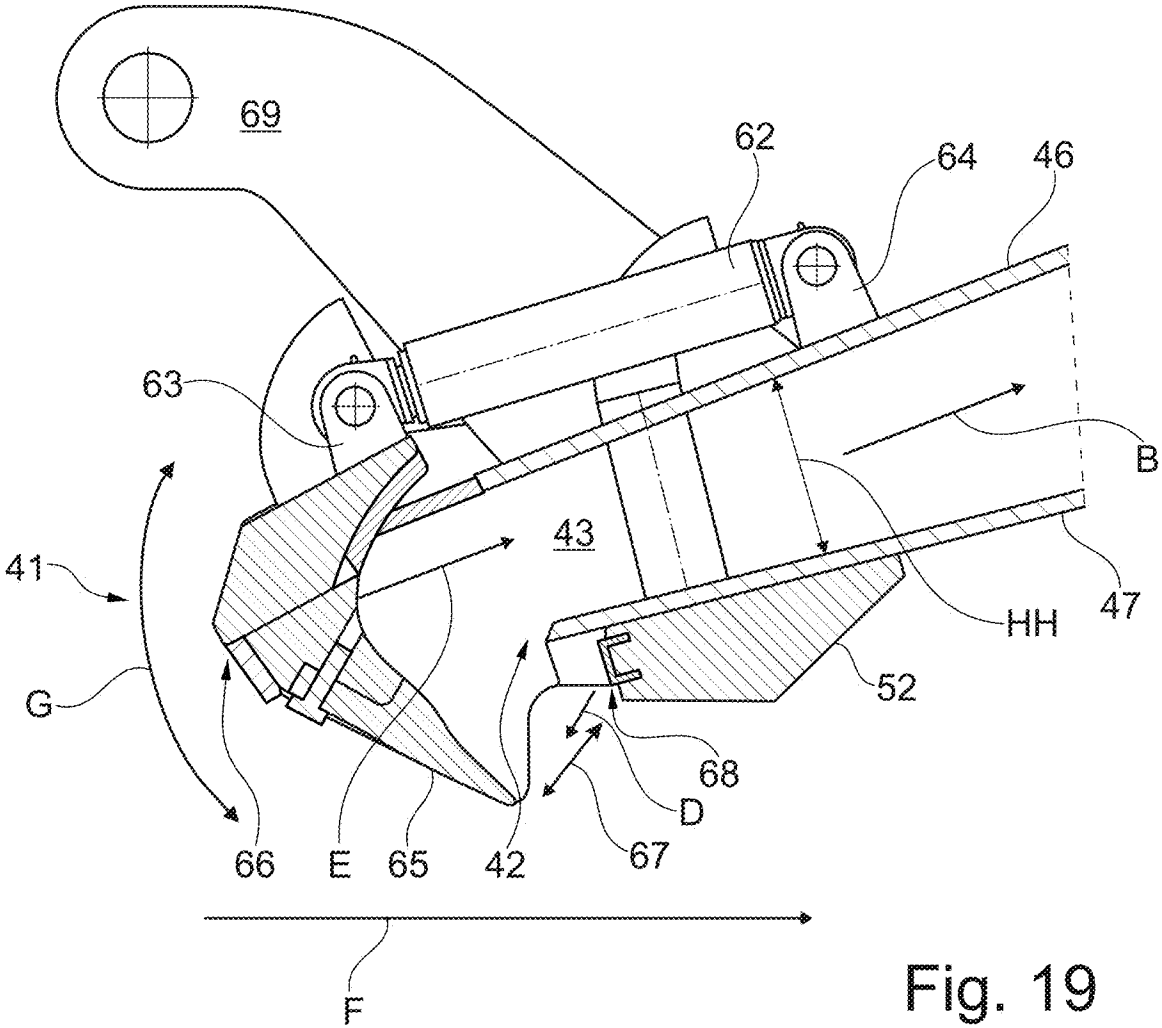

In a second embodiment, the body 11 on the lower side 13 thereof furthermore has a suction box 40. The suction box 40 is illustrated in detail in FIGS. 16 to 19. FIG. 18 shows a sectional view 102 from FIG. 16. FIG. 19 here shows an enlarged view of the encircled region from FIG. 18. The suction box 40 in the region of the front side 41 thereof has an opening region 42 which has at least one opening 43.

The opening 43 of the second embodiment of the suction box 40 can have a classifying element (not illustrated here) which subdivides the opening 43 into opening portions 43*a*. The grain size of the loosened ground/rock that can enter the interior space 45 of the suction box 20 is determined by the classifying element.

The interior space 45 is formed by a lid 46 as the upper side and a base 47 as the lower side, said lid 26 and said base 27 as one embodiment here being embodied in a planar manner. Other shapes of lids and bases are likewise possible. The suction box 40 furthermore has lateral walls 48, the latter here from the front side 41 extending along the shape of the lid and of the base.

As a consequence of the shape of the lid 46, of the base 47 and of the lateral walls 48, a funnel is preferably configured, for example, in that the width BB of the interior space 45 decreases as a result of the curved shape of the lateral walls 48, as a result of which the velocity of the flow of the suctioned mixture composed of the loosened ground/rock and the carrier medium increases as the width BB decreases. Additionally, the height HH of the interior space 45 of the suction box 40, proceeding from the front side 41, varies toward the opening 49 on the rear side of the suction box 40. Said height HH in the second embodiment is enlarged so as to counteract blockages of the interior space 45 as a result of loosened ground/rock. Other variations in terms of height are likewise possible in order to generate specific flow profiles in the interior space 45. This also applies to the suction box 20 of the first embodiment.

An opening 49 on which a connector 40 for a conveying line 41 is provided, which line during the drilling operation is connected to a pump (not illustrated) so as to perform the discharge of the loosened ground/rock, or of the mixture composed of the conveying medium and the loosened ground/rock, is provided on the rear side of the interior space 45.

Additionally, and not illustrated here, in the context of the second embodiment of the suction box 40 according to the invention, it is possible for the suction box 40, here illustrated as symmetrical, to be embodied asymmetrically in that the opening 49 is disposed so as to be laterally offset, for example. It is particularly expedient here for the opening 49 to be disposed so as to be offset toward the circumference 16 of the body 11 so as to increase in a targeted manner the flow velocity in those regions in which more ground/rock is loosened in the rotation in the rotating direction F and enters the interior space 25 of the suction box 40 through the opening 43.

Alternatively, the same is also possible in that the connector 40 of the conveying line 41 opens into the interior space 45 so as to be inclined into the latter.

Disposed upstream of the opening 43 is a deflecting element 60 which by way of articulation points 61 on the suction box 40, for example on the lateral walls 48 of the latter, is disposed so as to be movable. This here is preferably a rotating movement in the rotating direction G about the articulation points 61. At least one actuator 62, for example a hydraulic cylinder, is provided for moving the deflecting element 60. Said actuator 62 is connected to, for example a first detent 63 disposed on the deflecting element 60 and to a second detent 64 disposed on the lid 46 so that the pivoting movement can be carried out when activating the actuator 62. The deflecting element 60 in this instance can be folded in the rotating direction G.

At least one ground loosening tool 65 is disposed on the end of the deflecting element 60 that lies opposite the first detent 63. The deflecting element 60 can furthermore have nozzles 66 which, for example, from a carrier medium, for example a liquid or air, dispense a jet in the direction E into the interior space 45. As a result thereof, material that is situated in the interior space 45 can be moved in the direction B to the opening 49. When dispensing a liquid, the latter can be used, for example, or alternatively also for liquefying the loosened/conveyed material in the suction box 20 and/or the opening region 22, and thus for guaranteeing improved discharging. The conveying flow in the conveying line 31 and/or the liquefaction here are/is advantageously conceived such that the loosened/conveyed material does not back up in the opening region 22, but the opening region 22 remains substantially vacant.

A friction element 52 disposed on a base plate 55 is provided on the base 47.

As a function of the degree of pivoting of the deflecting element 60, an opening gap 67 exists between the base plate 55 and the ground loosening tool 65. The size of said opening gap 67 is determined by the quantity of material in terms of loosened ground/rock that has been picked up, for example. Classifying can furthermore be performed by way of the opening gap 67, for example, so as to prevent the entry of specific grain sizes of loosened ground/rock.

Furthermore, a nozzle 68 which, as a cleaning element from a carrier medium, for example a liquid or air, dispenses a jet in the cleaning direction D so as to remove jammed material from the opening gap 67 can be disposed on the base plate 55. When dispensing a liquid, the latter can be used, for example, or alternatively also for liquefying the loosened/conveyed material in the suction box 20 and/or the opening region 22, and thus for guaranteeing improved discharging. The conveying flow in the conveying line 31 and/or the liquefaction here are/is advantageously conceived such that the loosened/conveyed material does not back up in the opening region 22, but the opening region 22 remains substantially vacant.

Furthermore, an articulation element 69 that is connected to an actuator which is not illustrated and by way of which the entire suction box 40 is movable in relation to the body 11 so as to move the entire suction box 40 closer to the face, for example, or remove said suction box 40 from the latter, as a result of which the penetration depth into the face and/or the quantity of loosened material picked up are/is able to be influenced is illustrated in FIG. 19, for example.

The opening 23 of the suction box 20 of the first embodiment thus faces directly the rotating direction A, whereas the opening 43 of the suction box 40 of the second embodiment is not directly reached. The loosened material that passes through the opening gap 67 first has to be deflected to the flow direction by the deflecting element 60 and fed to the opening 43. Liquefying can then take place here in a corresponding manner. The ground loosening tools 65 of the second embodiment are thus pulled across the face, while the ground loosening tools 33 of the first embodiment are pushed across the face.

FIG. 20 to FIG. 23*b* in a three-dimensional illustration show a drill head 10 according to the invention in a third embodiment. The drill head 10 has a body 11, drilling tools 12 being disposed on the lower side 13 thereof. The drill head 10 on the upper side 14 thereof has a connector 15 for a drive (not illustrated) of a drill device (not illustrated). The drive, not illustrated, here is provided directly in the drilling device, for example, the latter being disposed in a casing tube (not illustrated) or in a pile (not illustrated), for example. A further, not final, alternative can also be a top drive which is provided on a casing tube or a pile and by way of which the drill head 10 is connected by way of a stem. Further variants of drives, drill devices and assemblies in a borehole/pile are likewise possible. Alternatively, the use of the drill head in conjunction with a shaft drilling machine is also possible.

Figure 20:
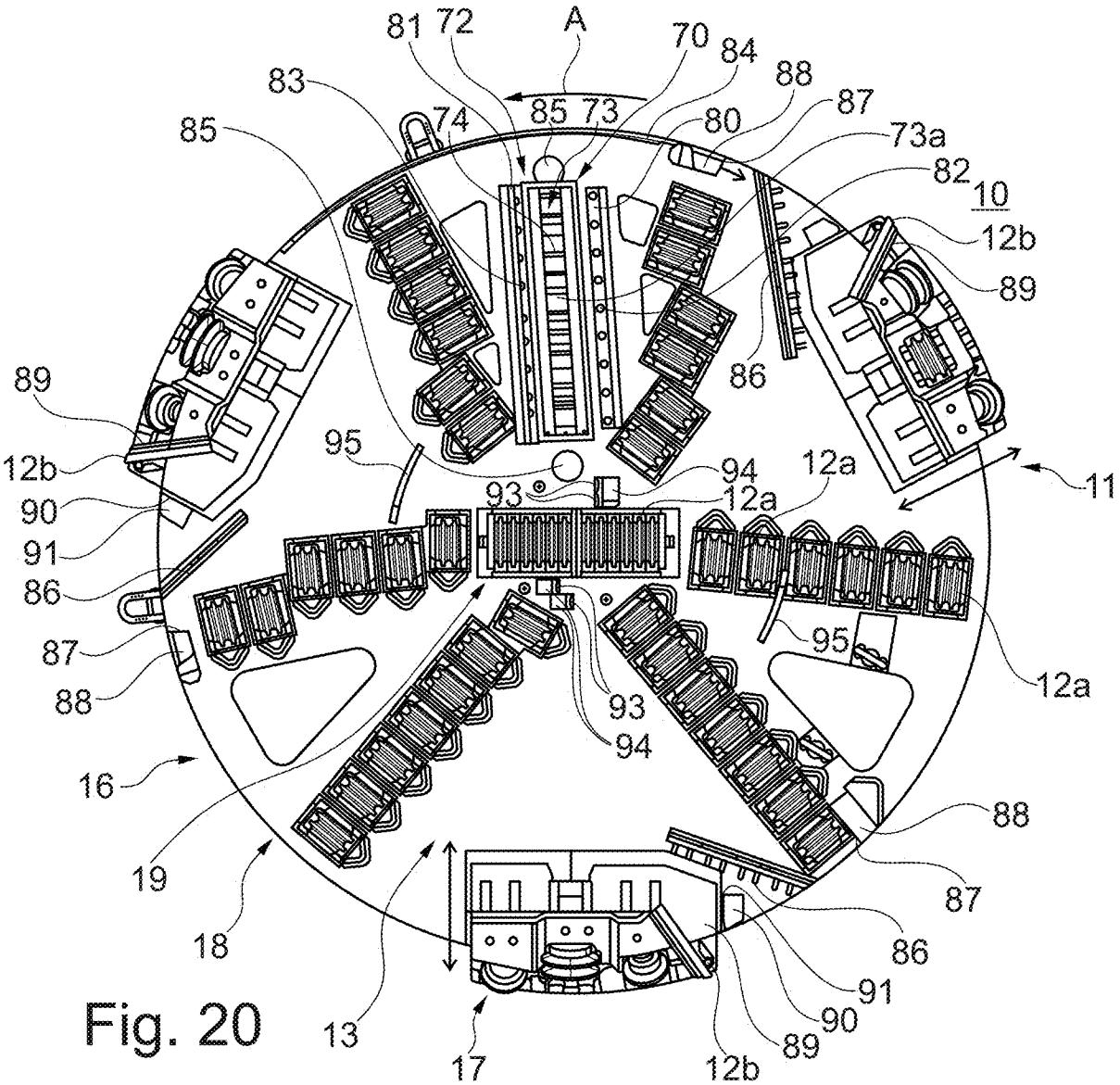
Figure 21:
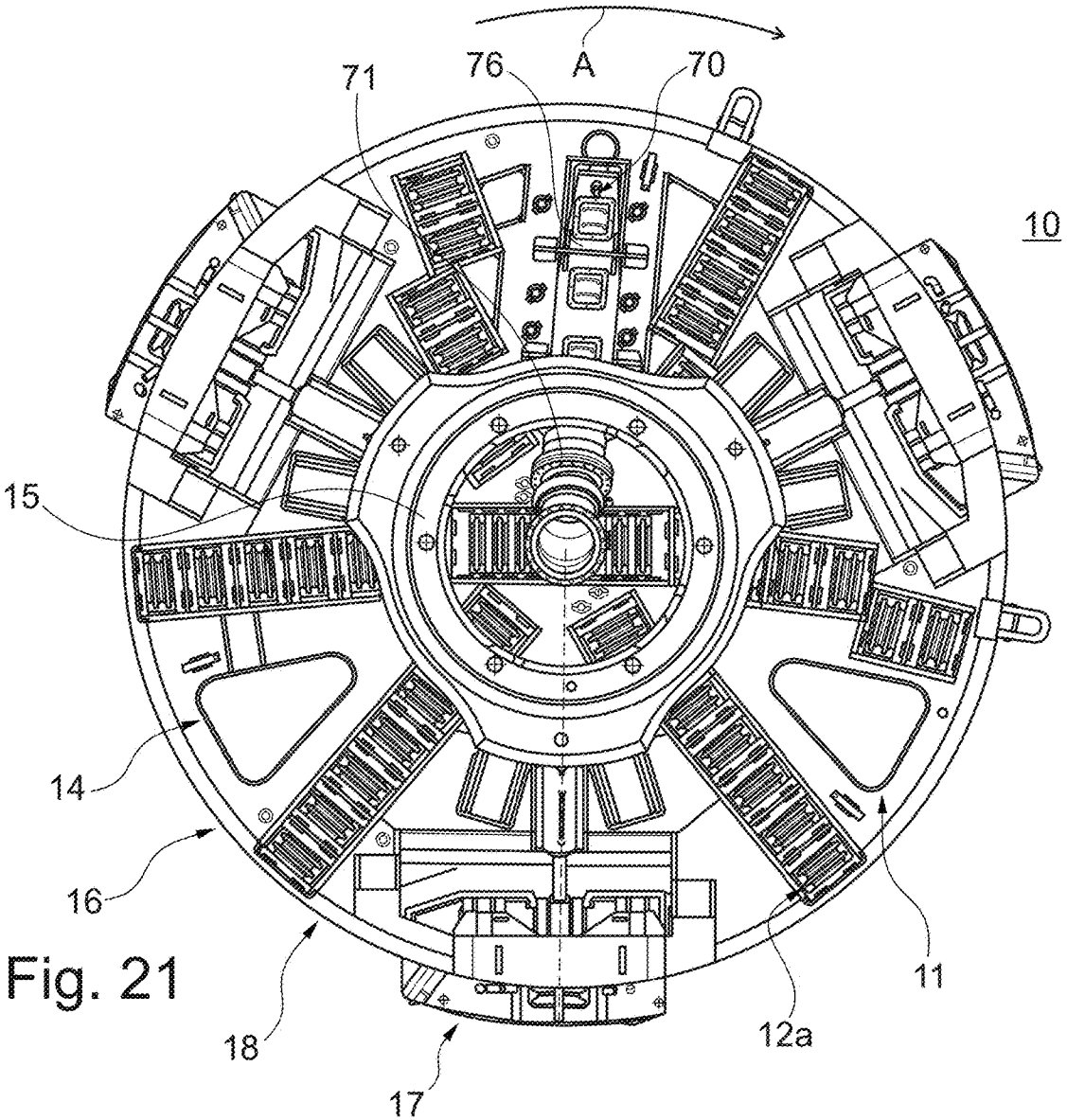
Figure 22:
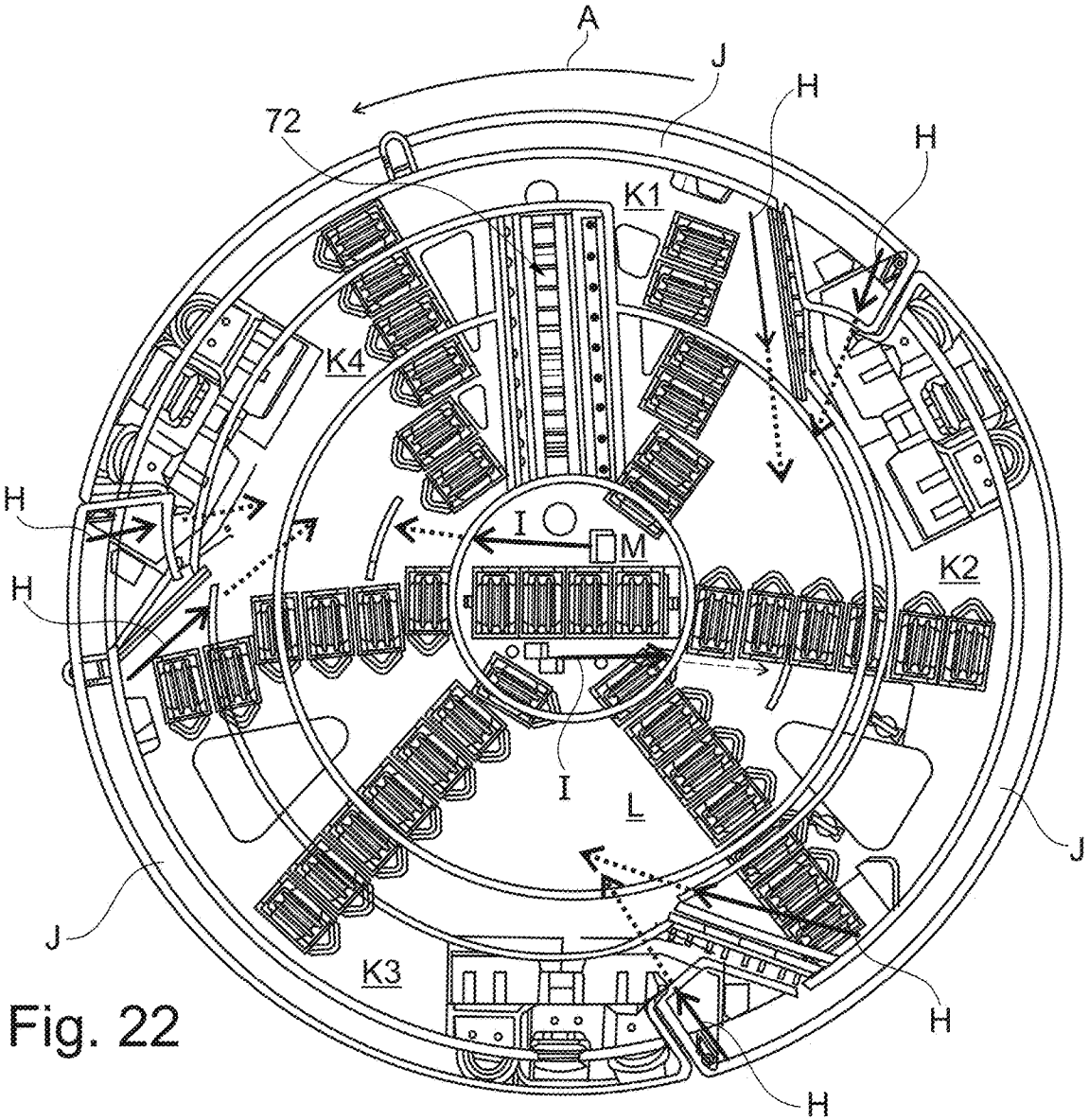
Figure 23A:
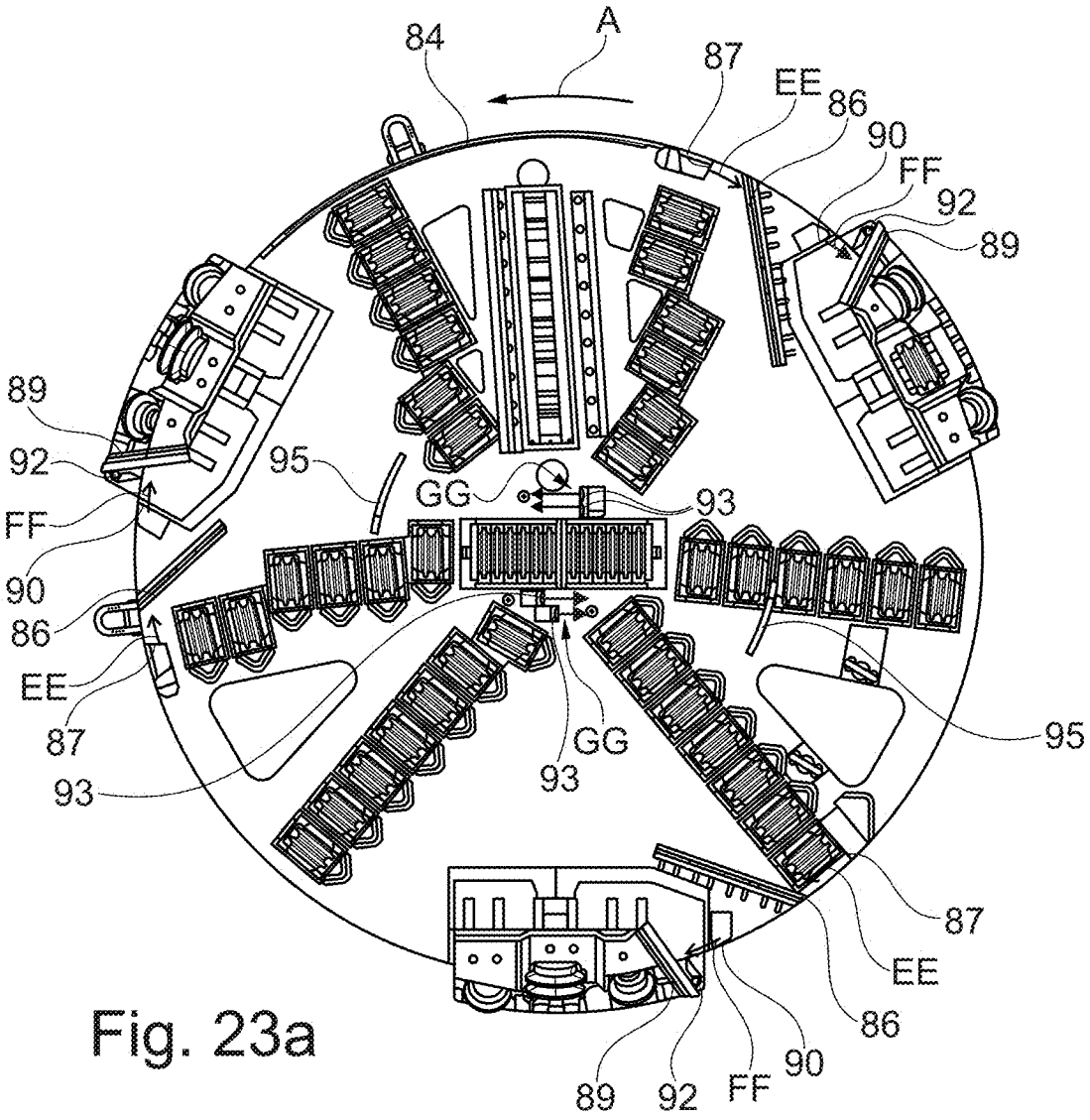
FIG. 23*a* shows FIG. 20 having medium jets dispensed by nozzles for the transportation of material illustrated.
Figure 23B:
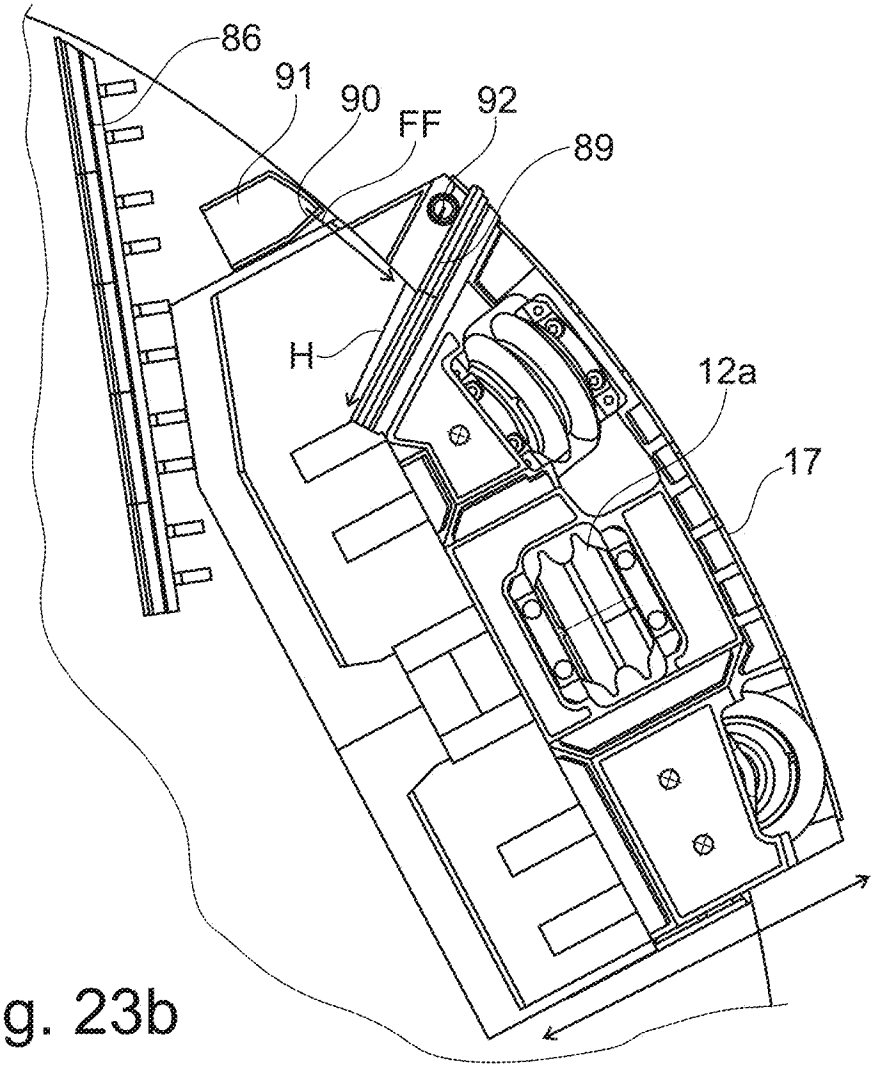
FIG. 23*b* shows an enlarged partial fragment of FIG. 23*a;*
Figure 24:
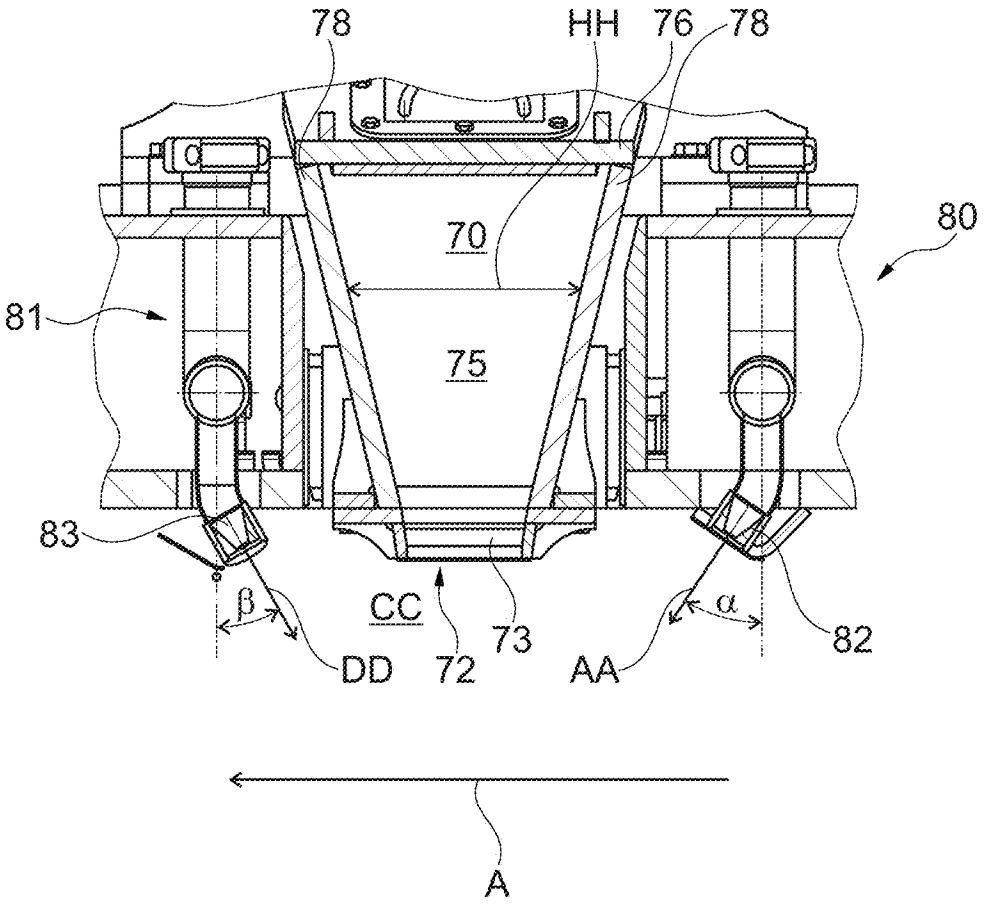
Figure 25:
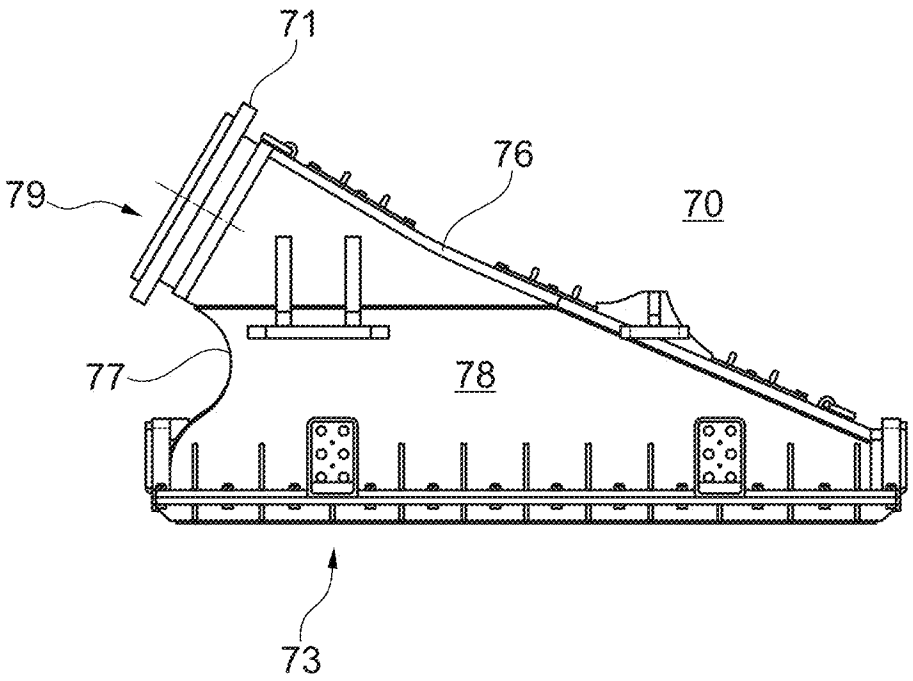
Figure 26:
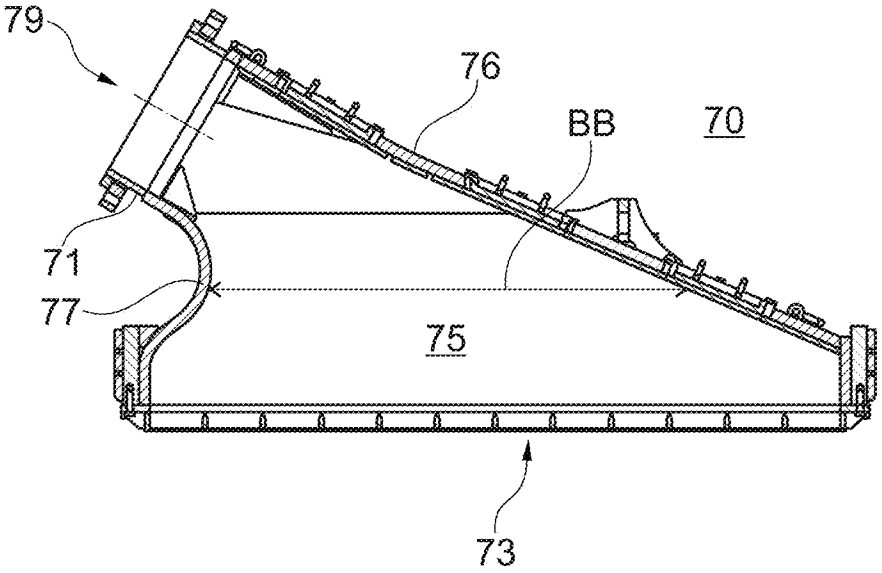
Figure 27:
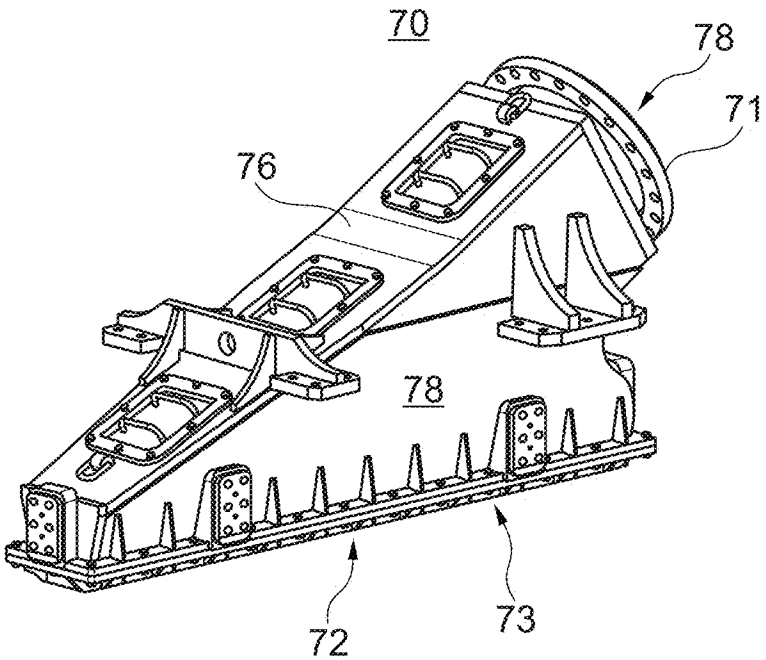
Figure 28:
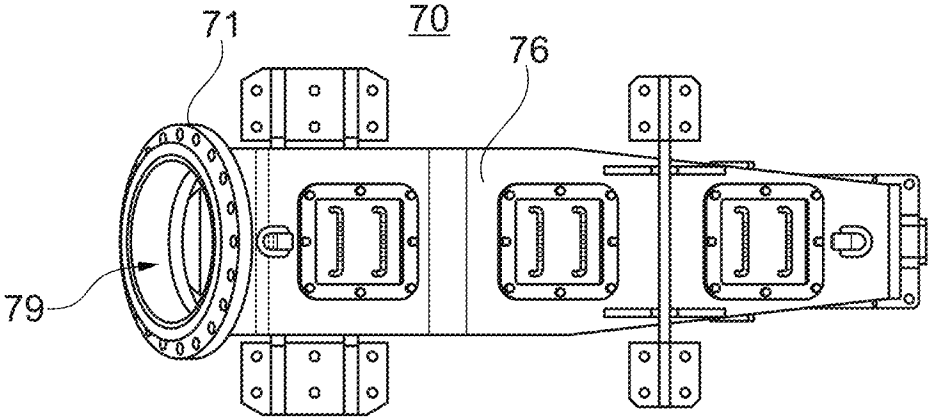
Figure 29:
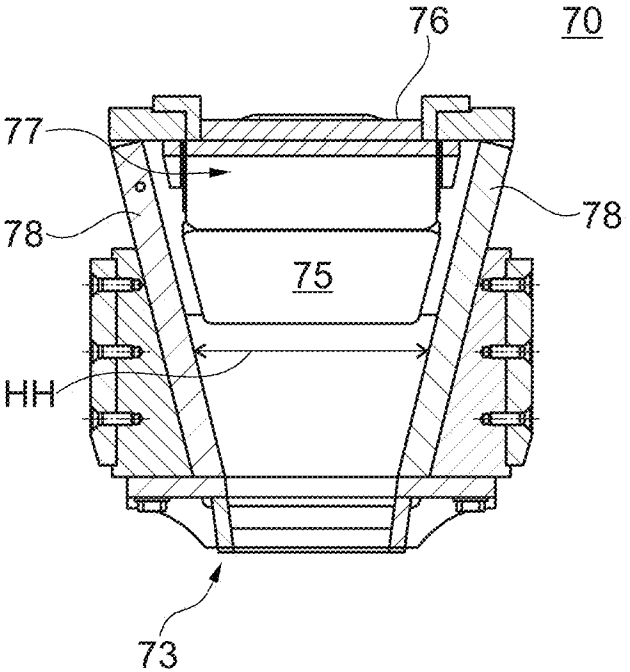
Figure 30:
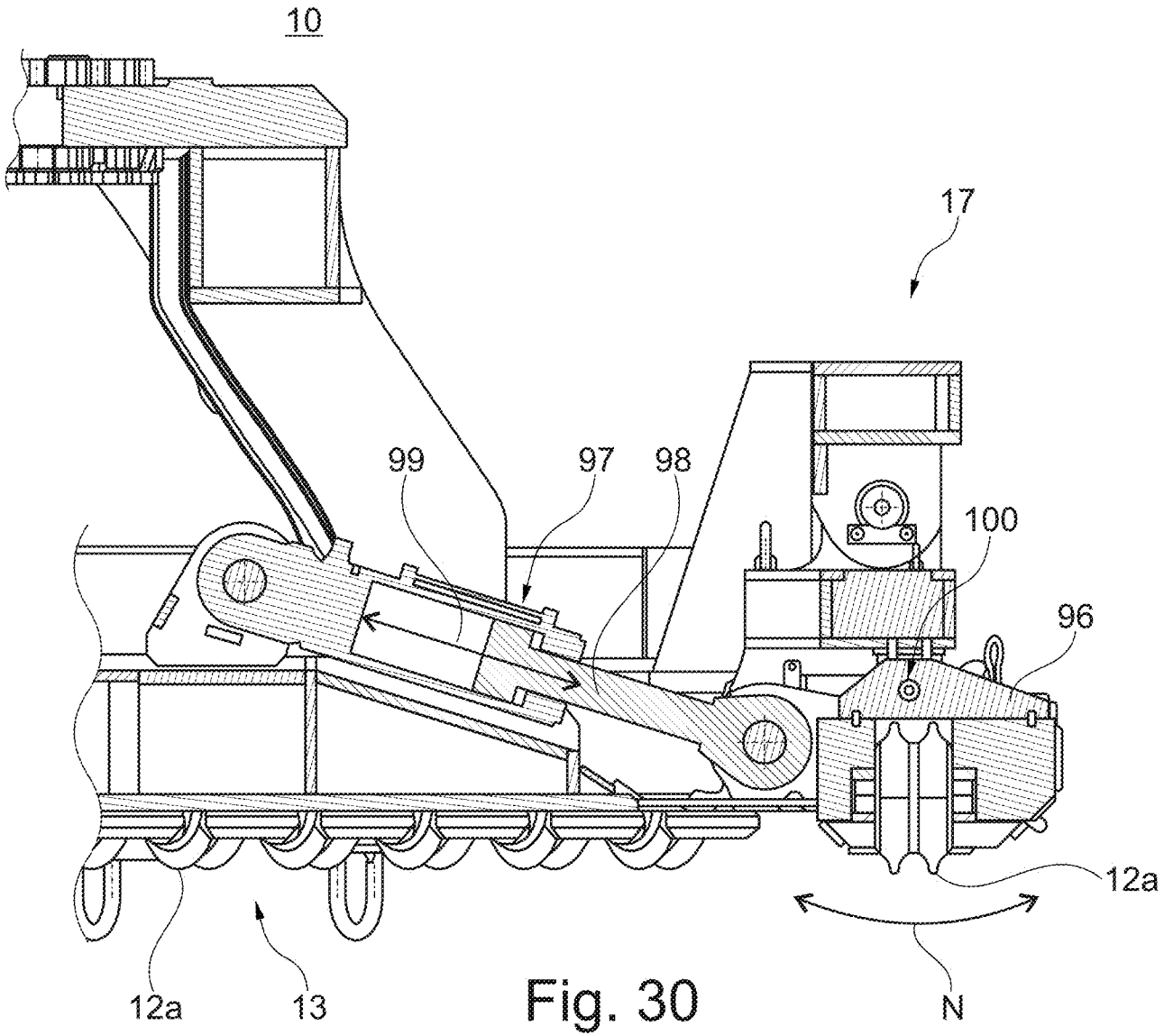
Figure 31:
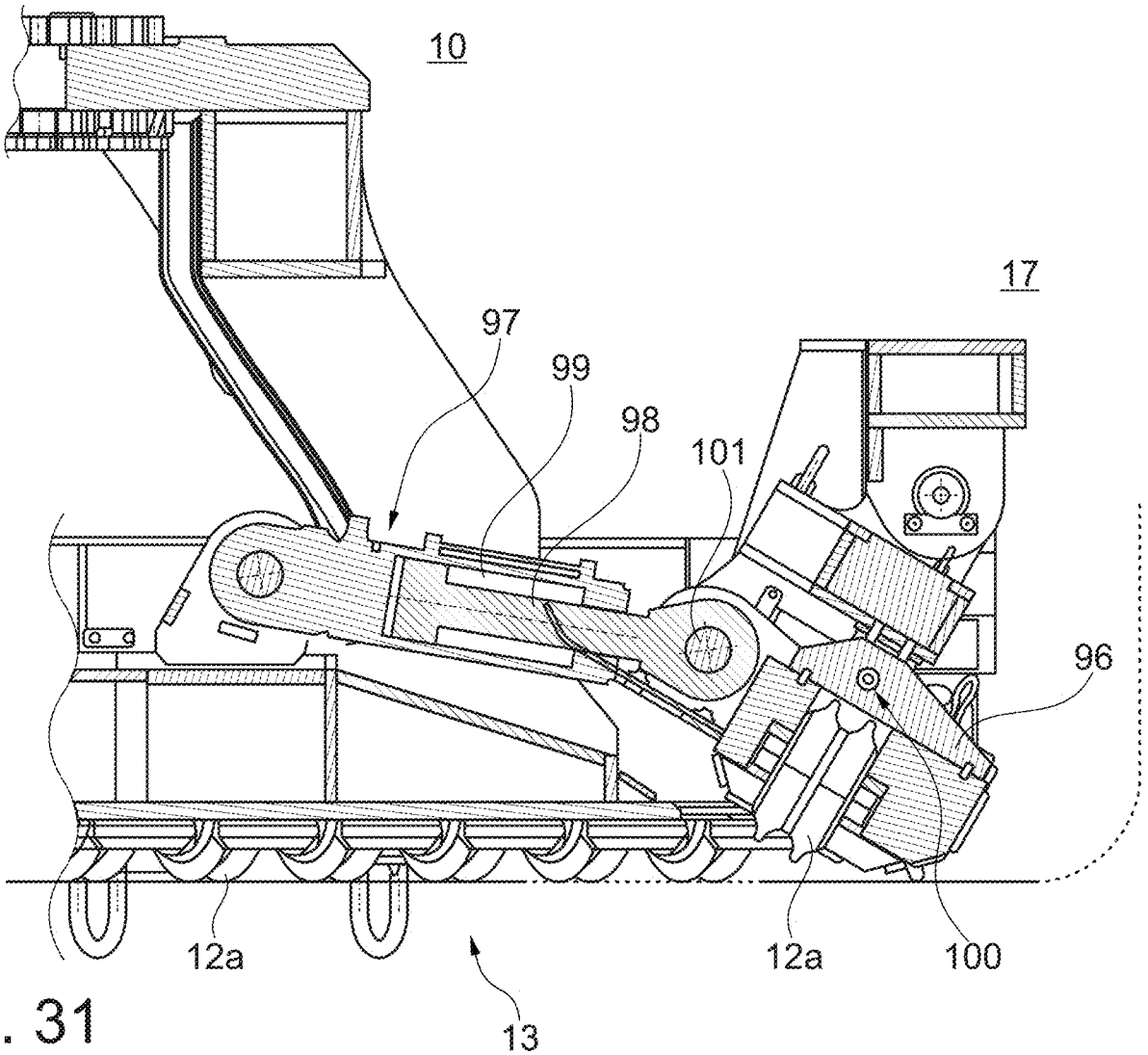

In order to enable undercuts below a casing tube or a pile, for example, the body 11 on the circumference 16 thereof can have deployable peripheral cutting tools 17 which are illustrated as deployed in FIG. 20. The individual states of the peripheral tool 17 are shown in FIGS. 29 to 31. Furthermore provided in an exemplary manner on the circumference 16 on the body 11 are consumable elements 18.

The drilling tools 12 can be, for example, chisel disks 12*a*, peeling chisels 12*b*, or roller chisels 12*c*. The selection of the drilling tools 12 takes place as a function of the ground/rock to be loosened in order for the borehole to be established. Illustrated here are chisel disks 12*a*.

As an alternative to the above-described centering drilling tool 19, a row of disks 12*a* which likewise enable centering of the drill head 10 are provided in the center of the lower side 13.

In a third embodiment, the body 11 furthermore has a suction box 70. The suction box 70 is illustrated in detail in FIGS. 24 to 29. Said suction box 70 has an opening region 72 which has at least one opening 73.

The opening 73 of the third embodiment of the suction box 70 has a classifying element 74 which subdivides the opening 73 into opening portions 73*a*. The grain size of the loosened ground/rock that can enter the interior space 75 of the suction box 70 is determined by the classifying element 74.

The interior space 75 is formed by a lid 76 as the upper side and a base 73 as the lower side, as well as by lateral walls 78 and a rear wall 77.

As a consequence of the shape of the lid 76, of the rear wall 77 and of the lateral walls 78, a funnel is preferably configured, for example, in that the width BB of the interior space 75 (see FIG. 26) decreases as a result of the shape and disposal of the lid 76 and of the rear wall 77, as a result of which the velocity of the flow of the suctioned mixture composed of the loosened ground/rock and the carrier medium increases as the width BB decreases.

An opening 79 on which a connector 71 for a conveying line (not illustrated) is provided, which line during the drilling operation is connected to a pump (not illustrated) so as to perform the discharge of the loosened ground/rock, or of the mixture composed of the conveying medium and the loosened ground/rock, is provided on the rear side of the interior space 75.

Additionally, the height HH of the interior space 75 of the suction box 70, proceeding from the opening region 72, increases toward the opening 79 on the upper side of the suction box 70 so as to counteract blockages of the interior space 75 as a result of loosened ground/rock.

A nozzle bar 81 is provided in front of the opening region 72 in the rotating direction, and a second nozzle bar 80 is provided behind the opening region 72 in the rotating direction, both so as to be parallel to the opening region 72, or to the opening 73, respectively, on the lower side 13 of the drill head 10. The nozzle bars 81 have a multiplicity of nozzles 82, 83 disposed in series. These nozzles 82, 83 each dispense a jet AA, DD of a purging medium, preferably a liquid jet or a compressed air jet. The nozzles 82 of the nozzle bar 80 and the nozzles 83 of the nozzle bar 81 are disposed such that said nozzles are aligned onto the face and toward the opening region 72. The nozzles 82 here on the lower side 13 of the drill head 10 are disposed at an angle $\alpha$ in relation to the vertical, and the nozzles 83 on the lower side 13 of the drill head 10 are disposed at an angle $\beta$ in relation to the vertical. The angle $\alpha$ and the angle $\beta$ preferably differ from one another. The angle $\beta$ here is particularly preferably smaller than the angle $\alpha$. The jets AA here impact the face (not illustrated) and cause the loosened ground to be swirled or activated, respectively, so that this loosened ground can more readily be suctioned into the opening 73. Furthermore, a blocking effect is also created by the jets AA such that loosened ground ideally cannot exit the region CC between the jet AA and the jet DD counter to the rotating direction A. The blocking effect is improved as the angles $\alpha$, R between the face and the vertical increase. In contrast, the effect of loosening/accelerating the loosened ground improves up to an angle $\alpha$, p to be determined in an optimal manner if the angle $\alpha$, p decreases.

The jet DD, which in comparison to the jet AA is directed straighter onto the face, substantially causes a blocking effect so that material or loosened ground, respectively, that has been activated by the jet AA and thus been accelerated in the rotating direction cannot exit the region CC in the rotating direction A.

Furthermore preferably provided here on the external circumference of the lower side 13 of the drill head 10 in the region of the suction box 70 is a flow ring 84. Proceeding from the lower side 13, the flow ring 84 extends toward the face. Said flow ring here is preferably implemented as a metal sheet provided on the circumference 16 of the drill head 10. The flow ring 84 has the effect that the suctioning through the opening 73 is not performed in the form of a short circuit from the peripheral region of the borehole.

In order for the suctioned liquid to be filled below the drill head 10, openings 85 here are preferably provided on the right and on the left on the short side of the opening 73 and are connected to a line (not illustrated) by way of which the liquid is fed to the intake region. It is in particular avoided as a result of the preferably targeted infeed in the intake region that crossflows are created below the drill head 10 in the extraction region, as a result of which an uncontrolled transportation of material would arise. Apart from wear, such an uncontrolled transportation of material also leads to already loosened ground being repeatedly traveled across by the drilling tools 12.

In order to effect an optimal transportation of material of the loosened ground to the opening region 72 of the suction box 70, a centralizing unit is preferably provided, preferably on the lower side 13 of the drill head 10. This centralizing unit is composed of baffles and nozzles by way of which loosened ground in specific regions is fed to that region of the face that is traveled across by the opening region 72 of the suction box 70. Controlling of the material flow is effected in a simple manner as a result thereof, by way of which an optimized distribution of material from those regions in which more ground is loosened on the face to those regions in which less ground is loosened by the drilling tools 12 is able to be achieved in order to optimize the suctioning.

Provided to this end are baffles 86 of various lengths and incidence angles, said baffles 86 being provided directly behind drilling tools 12 disposed in specific portions. The baffles 86 here extend from the lower side 13 of the drill head 10 toward the face. Said baffles are diagonally disposed such that the loosened material, or the loosened ground, respectively, is moved efficiently from the external regions of the lower side 13 of the drill head 10 toward the opening region 73. This transportation of material is effected by nozzles 87 which are in each case provided in a housing 88 on the external side of the lower side 13 of the drill head 10. The nozzles 87 here dispense a tangential jet EE of a purging medium (liquid or air) that impacts the respective baffle 87. The jet EE on the baffle 87 is then deflected in the flow direction HH parallel to the baffle 87. The material that is loosened by the drilling tools 12 in front of the respective baffle 86 is then transported in the direction HH by this purging medium flow.

Furthermore, the peripheral cutting tools 17 also have baffles 89 which are likewise diagonally disposed such that material from the outside, as a result of the production of the drill head 10, is able to be transported along the baffle 89 toward the inner region of the lower side 13 of the drill head 10. In turn, nozzles 90 that direct a jet FF of a purging medium (liquid or air) onto the baffle 89 are also provided in a housing 91 such that the flow direction of the jet FF is changed at the baffle 89 such that said flow direction runs in the direction HH parallel to the baffle 89. A peeling chisel 12*b* which cuts and straightens the wall of the borehole is preferably provided on the external side of the baffle 89 of the peripheral cutting tool 17. A nozzle 92 which dispenses a jet (not illustrated) of a purging and cooling medium (liquid or air) is provided for cooling and purging the peeling chisel 12*b*. The jet here is directed along the peeling chisel 12*b* toward the face region. The loosened material that is purged here is then acquired by the baffle 89 and likewise transported away from the nozzle 90 in the flow direction HH, preferably in combination with the jet FF.

In the region of the center in which the centering drilling tool 19 is embodied, the latter here preferably being embodied as a row of disks 12*a*, nozzles 93 are provided in a housing 94 so as to be parallel to the row, said nozzles dispensing a jet GG of a purging medium (liquid or air) in the flow direction I parallel to the row of disks 12*a* such that the loosened material that is loosened by the respective disks 12*a* is conveyed out of the center by the jets GG. Baffles 95 which here are embodied in a curved manner and disposed circumferentially on the lower side 13 of the drill head 10 in a region of the face that is traveled across by the opening region 73 of the suction box 70 are provided for delimiting this material flow.

The lower side 13 of the drill head by the baffles and nozzles is divided into different material conveying portions J to M. The baffles 89 in conjunction with the nozzles 90 in the region of the peripheral cutting tools 17 have the effect of an external conveying region J, the latter being shown in FIG. 22. The ground which is loosened by the drilling tools 12 in these regions is conveyed by the baffles 89 in the flow direction HH into the regions K1 to K4 to L that are situated further inward and are concentric with the former. The regions K1 to K4 here are preferably of different sizes because the respective associated baffles 86 are preferably embodied in different length. As a result thereof, a targeted distribution of material is achieved into the annular region L or into a region K4 situated outside the latter, said region is then being travelled across by the suction box 70, as a result of which a discharge of the loosened ground takes place. These regions are likewise shown in FIG. 22. The center M is situated within the annular region L, the material loosened in said center M then being conveyed in the flow direction I against the baffles 95 and into the region L. A targeted distribution of material takes place here in such a manner that the bulk of the conveyed material can be received by the inner part of the opening region 73 such that the discharge of material, or the suctioning, respectively, is significantly improved as a result.

Figure 32:
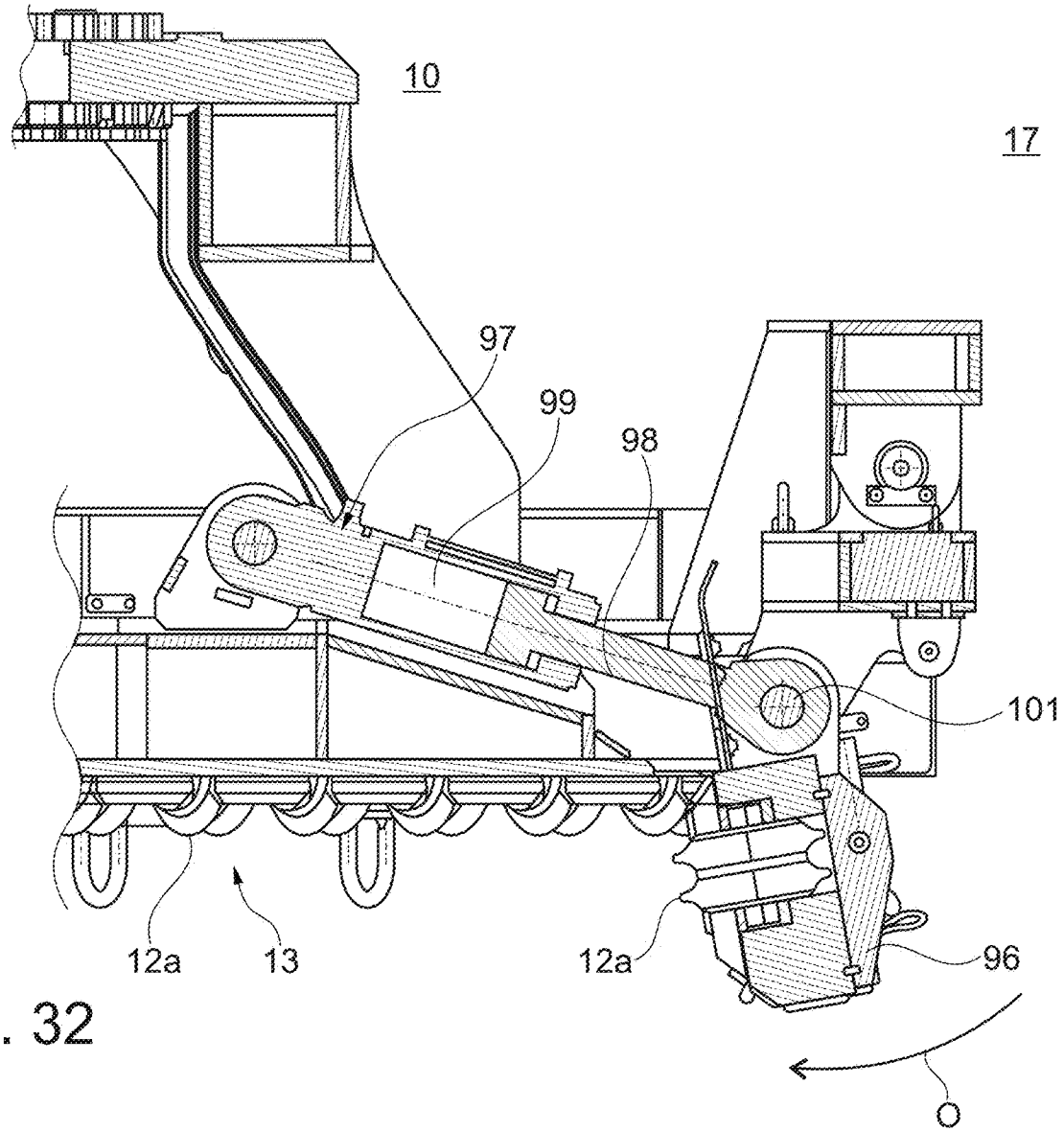

The states of movement of the peripheral cutting tool 17 are shown in FIGS. 30 to 32. Said peripheral cutting tools 17 here have a main body 96 which is able to be moved in the direction of the arrow N. Provided to this end is an actuator 97 which here is preferably embodied as a hydraulic cylinder. FIG. 30 shows the deployed position of the peripheral cutting tools 17, while FIG. 31 shows the retracted position. The main body 96 is retracted into the body in 11 of the drill head 10 or deployed therefrom by moving a piston 98 in the cylinder 99 by way of the piston rod of said piston 98. An emergency solution for recovering the drill head 10 upon completion of the drilling works is shown in FIG. 32, in which emergency the main body is no longer able to be retracted by virtue of a malfunction or a failure of the actuator 97. Provided to this end is a shear pin 100 which in the normal operating state functions as a rotary bearing for pivoting the main body 96 into the body 11 of the drill head 10 in the moving direction N. In the event of a malfunction, this shear pin 100 is shorn off such that the main body 96 is pivotable in the direction of the arrow O about the articulation 101. The articulation 101 is the point of engagement of the actuator 97 on the main body 96.

List of reference signs:

| | |
|---|---|
| 10 | Drill head |
| 11 | Body |
| 12 | Drilling tool |
| 12a | Chisel disk |
| 12b | Peeling chisel |
| 12c | Roller chisel |
| 13 | Lower side |
| 14 | Upper side |
| 15 | Connector |
| 16 | Circumference |
| 17 | Peripheral cutting tool |
| 18 | Consumable element |
| 19 | Centering drilling tool |
| 20 | Suction box |
| 21 | Front side |

-continued

| List of reference signs: | |
|---|---|
| 22 | Opening region |
| 23 | Opening |
| 23a | Opening portion |
| 24 | Classifying element |
| 25 | Interior space |
| 26 | Lid |
| 27 | Ground |
| 28 | Lateral wall |
| 29 | Opening |
| 30 | Connector |
| 31 | Conveying line |
| 32 | Friction element |
| 34 | Ground loosening tool |
| 34 | Nozzle |
| 35 | Cleaning element |
| 36 | Rod |
| 37 | Passage |
| 40 | Suction box |
| 41 | Front side |
| 42 | Opening region |
| 43 | Opening |
| 45 | Interior space |
| 46 | Lid |
| 47 | Ground |
| 48 | Lateral wall |
| 49 | Opening |
| 50 | Connector |
| 51 | Conveying line |
| 52 | Friction element |
| 53 | Ground loosening tool |
| 54 | Nozzle |
| 55 | Base plate |
| 60 | Deflecting element |
| 61 | Articulation point |
| 62 | Actuator/hydraulic cylinder |
| 63 | First detent |
| 64 | Second detent |
| 65 | Ground loosening tool |
| 66 | Nozzle |
| 67 | Opening gap |
| 68 | Nozzle |
| 69 | Articulation element |
| 70 | Suction box |
| 71 | Connector |
| 72 | Opening region |
| 73 | Opening |
| 73a | Opening portion |
| 74 | Classifying element |
| 75 | Interior space |
| 76 | Lid |
| 77 | Rear wall |
| 78 | Lateral wall |
| 79 | Opening |
| 80 | Nozzle bar primary nozzles |
| 81 | Nozzle bar secondary nozzles |
| 82 | Nozzle |
| 83 | Nozzle |
| 84 | Flow ring |
| 85 | Opening |
| 86 | Baffle |
| 87 | Nozzle |
| 88 | Housing |
| 89 | Baffle |
| 90 | Nozzle |
| 91 | Housing |
| 92 | Nozzle |
| 93 | Nozzle |
| 94 | Housing |
| 95 | Baffle |
| 96 | Main body |
| 97 | Actuator |
| 98 | Piston |
| 99 | Cylinder |
| 100 | Shear pin |
| 101 | Articulation point |
| 102 | Sectional View |
| A | Rotating direction |

-continued

| List of reference signs: | |
|---|---|
| B | Flow direction |
| C | Cleaning direction |
| D | Cleaning direction |

The invention claimed is:

1. A drill head, for creating a vertical borehole in the ground, comprising a body connectable to a rotary drive of a drilling device, wherein the body comprises;

drilling tools for loosening the ground at a face of the borehole;

a suction system, for discharging the loosened ground at the face, connectable to a pump, wherein the suction system has an opening region disposed on the body comprising at least one opening in a section of the drilling tools at the face, wherein:

the opening region is elongated;

the at least one opening of the opening region is connected to a suction box which at an end opposite to the opening has a connector opening for connecting to the pump;

the suction box comprises a first pair of opposite sides and a second pair of opposite sides, with a separation between the first pair of opposite sides increasing and a separation of a second pair decreasing between the opening and the connector opening, the ground loosened by the drilling tools in a flow direction is suctioned in the opening region through the opening and into the suction box by the pump;

wherein the suction box is disposed vertically.

2. The drill head as claimed in claim 1, wherein the suction box comprises a nozzle assembly which is directed from the opening toward the connector opening.

3. The drill head as claimed in claim 1, wherein the opening comprises a slot.

4. The drill head as claimed in claim 1, comprising nozzles which are directed into the at least one opening.

5. The drill head as claimed in claim 1, comprising at least two nozzles for dispensing a jet of a medium disposed in front of the opening relative to the direction of drill head rotation, on the lower side of the drill head, said nozzles being directed toward the face.

6. The drill head as claimed in claim 1, comprising at least two nozzles for dispensing a jet of a medium disposed behind the opening relative to the direction of drill head rotation, on the lower side of the drill head, said nozzles being directed toward the face.

7. The drill head as claimed in claim 1, comprising at least one nozzle for dispensing a jet of a medium provided on the lower side of the drill head, wherein the jet moves the loosened ground into a region of the face traversed by the opening during the rotation of the drill head.

8. The drill head as claimed in claim 7, comprising a baffle on the lower side of the drill head, wherein the baffle is disposed as one of a straight or curved element on the lower side of the drill head disposed, at least one of diagonal or at least partially circumferential, wherein the at least one nozzle jet hits the baffle, resulting in a change in the moving direction of the loosened ground.

9. The drill head as claimed in claim 1, comprising at least two nozzles in the center of the lower side of the drill head aligned in opposing directions.

10. The drill head as claimed in claim 1, comprising at least two nozzles tangentially aligned on the lower side of the drill head.

11. The drill head as claimed in claim 1 comprising radially adjustable peripheral cutting tools.

* * * * *